US006006458A

United States Patent [19]

Weiss

[11] Patent Number: 6,006,458

[45] **Date of Patent: *Dec. 28, 1999**

[54] MONUMENTS, MARKERS AND COLULMBARIUIMS WITH IMPROVED DISPLAY INDICIA

[76] Inventor: Hali Weiss, 37 Washington Square West, Apt. 3C, New York, N.Y. 10012

[ * ] Notice: This patent issued on a continued prosecution application filed under 37 CFR 1.53(d), and is subject to the twenty year patent term provisions of 35 U.S.C. 154(a)(2).

[21] Appl. No.: 08/842,691

[22] Filed: Apr. 15, 1997

Related U.S. Application Data

[63] Continuation-in-part of application No. 08/630,114, Apr. 8, 1996, Pat. No. 5,622,014, which is a continuation-in-part of application No. 08/149,050, Nov. 8, 1993, Pat. No. 5,517,791.

[51] Int. Cl.[6] ..... E04H 13/00

[52] U.S. Cl. ..... 40/124.5; 40/800; 52/103; 52/105

[58] Field of Search ..... 40/124.5, 800; 52/103, 105

[56] References Cited

U.S. PATENT DOCUMENTS

| | | | |
|---|---|---|---|
| 311,724 | 2/1885 | Crockett | 40/124.5 |
| D. 390,322 | 2/1998 | Weiss | D99/17 |
| 518,552 | 4/1894 | Snith | 40/124.5 |
| 581,156 | 4/1897 | Hammond | 40/124.5 |
| 819,394 | 5/1906 | Williams . | |
| 833,212 | 10/1906 | Howard . | |
| 872,241 | 11/1907 | Livingston | 40/124.5 X |
| 1,174,867 | 3/1916 | Jenkins . | |
| 1,397,483 | 11/1921 | Brown | 40/124.5 X |
| 1,434,479 | 11/1922 | Chernock . | |
| 1,453,375 | 5/1923 | Allen . | |
| 1,983,807 | 12/1934 | Norman . | |
| 1,994,937 | 3/1935 | Berger . | |
| 2,124,500 | 9/1938 | Taylor . | |
| 2,153,229 | 4/1939 | Arkin | 40/124.5 |
| 2,274,192 | 2/1942 | Deaton | 40/124.5 |
| 2,899,762 | 8/1959 | Wellman . | |
| 3,438,159 | 4/1969 | Berenger et al. | 40/124.5 |
| 3,481,089 | 12/1969 | Sheidow . | |
| 3,570,159 | 3/1971 | Burgener . | |
| 3,754,805 | 8/1973 | Pangburn et al. . | |
| 4,227,325 | 10/1980 | Whitford . | |
| 4,550,537 | 11/1985 | Smith . | |
| 4,607,417 | 8/1986 | Hancovsky . | |
| 4,614,066 | 9/1986 | Koppenberg . | |
| 4,637,325 | 1/1987 | Hong . | |

*Primary Examiner*—Robert Canfield
*Attorney, Agent, or Firm*—Walter W. Duft; Joseph P. Gastel

[57] ABSTRACT

In a first aspect of the disclosure, a monument is shown having a movable element mounted in an opening therein for displaying information. The movable element may be partially or fully recessed in the opening but is constructed so as to be accessible for manual movement to change the information displayed. In a second aspect of the dislosure, a columbarium niche structure is shown having a movable element positioned behind an opening in a door. The movable element is preferably recessed so that no portion thereof extends beyond the front face of the door, but is constructed so as to be accessible for manual movement to change the information displayed. An adjustment system is provided for aligning the movable element with the door opening, and a bearing system is used to facillitate movement of the movable element. In a third aspect of the disclosure, grave markers, columbarium niches and monuments are shown which display both text information and imprinted images made by casting a shape, such as a body part of a deceased individual. In a fourth aspect of the disclosure, a flush mounted metallic grave marker displays summary information about a deceased individual and includes additional structure for displaying more detailed information which cannot be readily formed on the surface of the metallic marker.

10 Claims, 20 Drawing Sheets

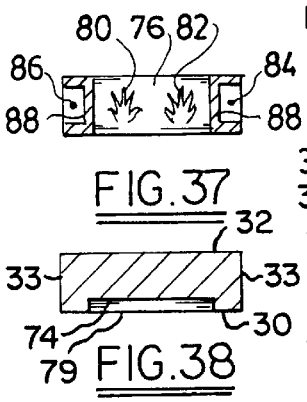
FIG.37
FIG.38
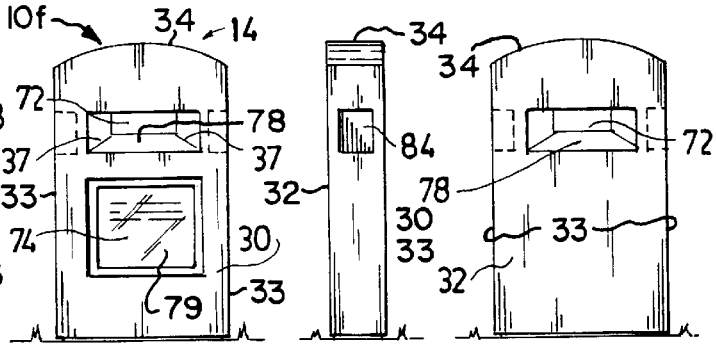
FIG.34 FIG.35 FIG.36
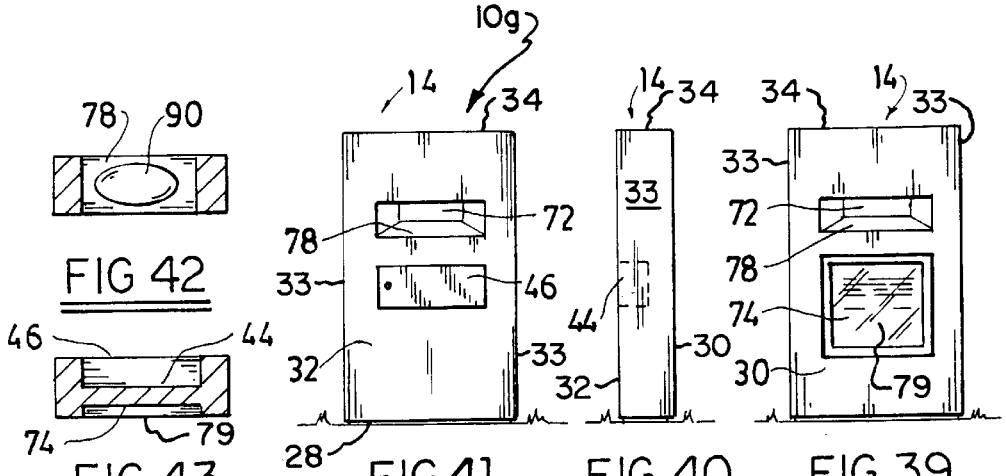
FIG 42 FIG.43 FIG.41 FIG.40 FIG.39
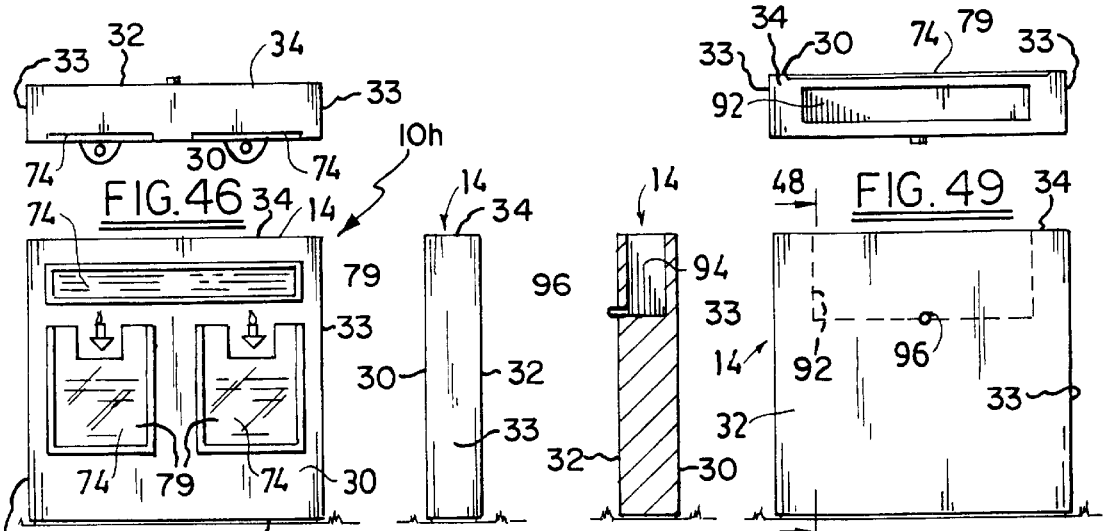
FIG.46 FIG.44 FIG.45 FIG.48 FIG.49 FIG.47

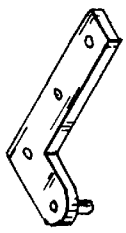
FIG. 106
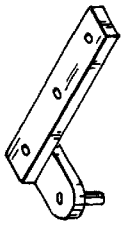
FIG. 107
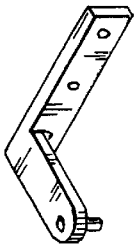
FIG. 108
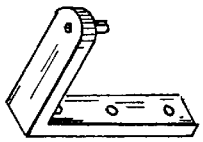
FIG. 109
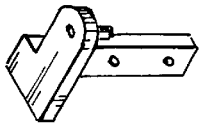
FIG. 110
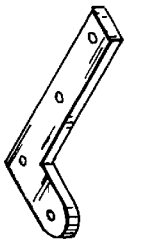
FIG. 111
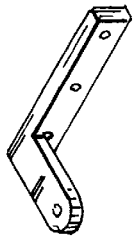
FIG. 112
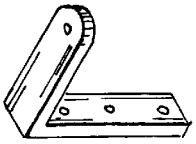
FIG. 113
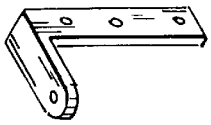
FIG. 114
FIG. 115
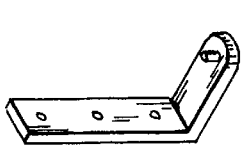
FIG. 116
FIG. 117
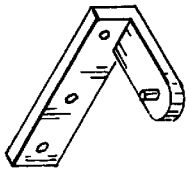
FIG. 118
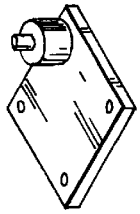
FIG. 119

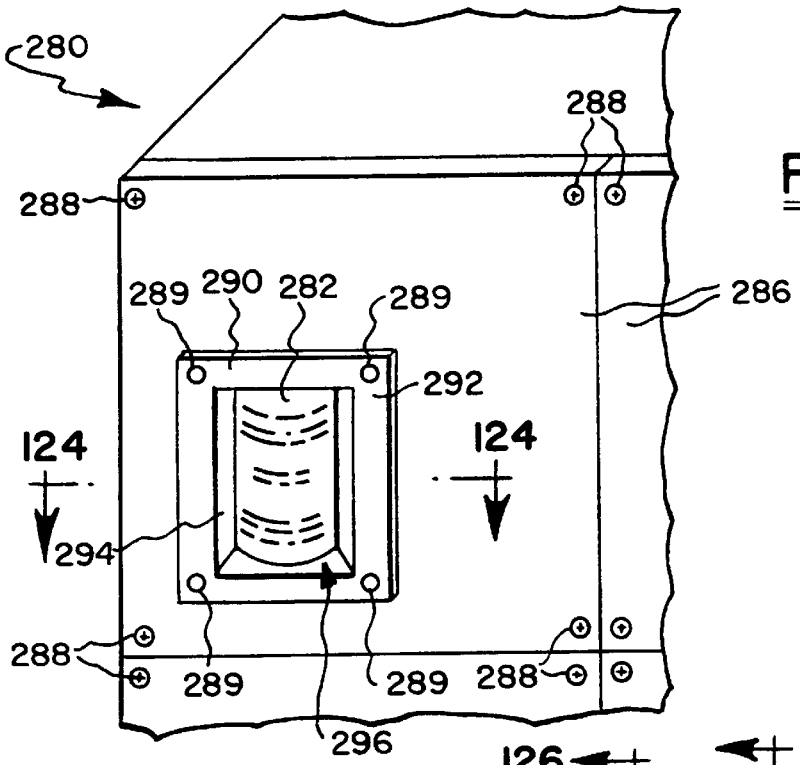
FIG. 123.
FIG. 124.
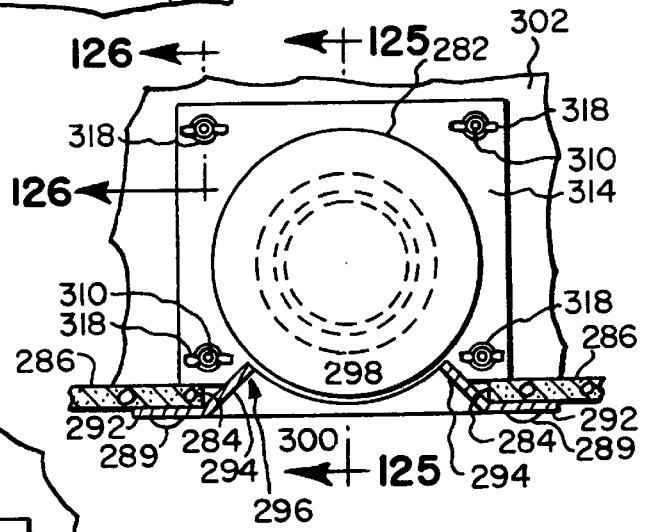
FIG. 125.
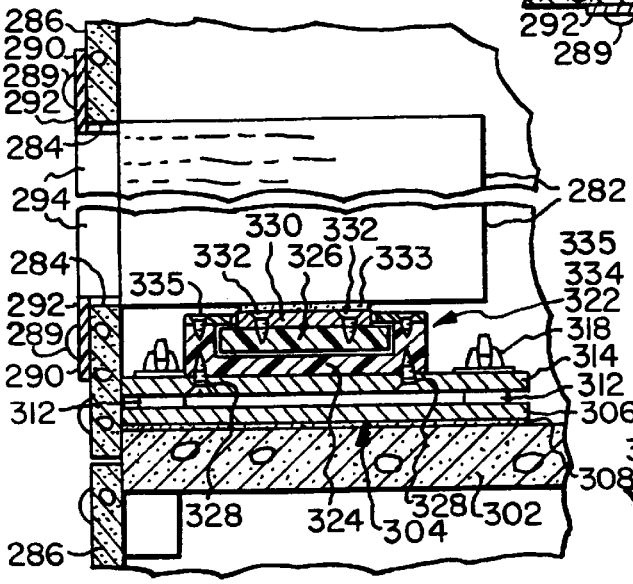
FIG. 126.
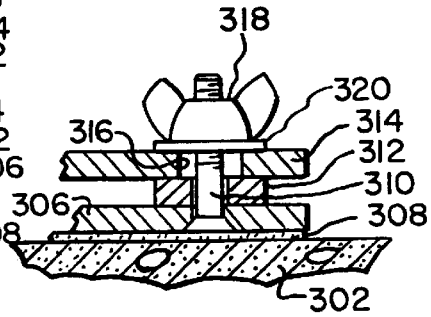

FIG. 127.
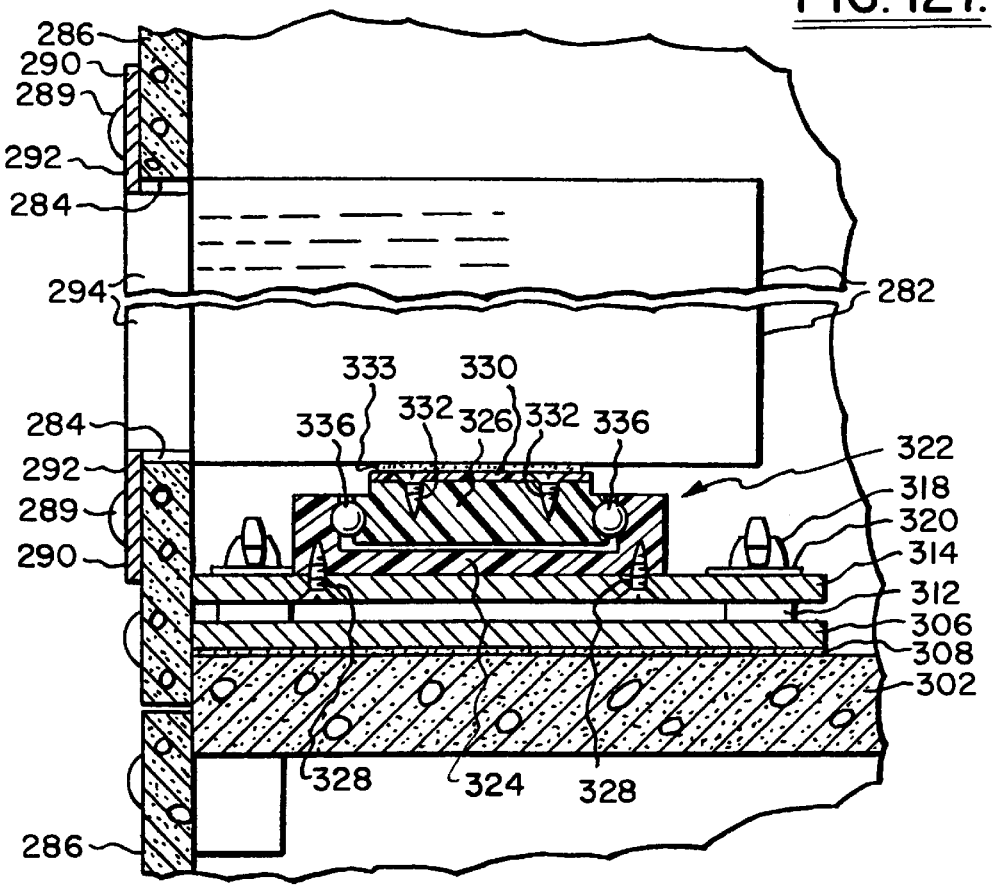
FIG. 128.
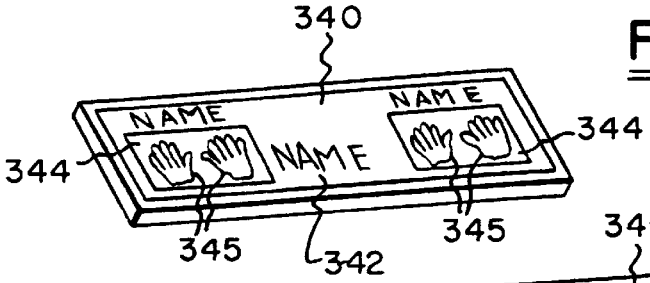
FIG. 129.
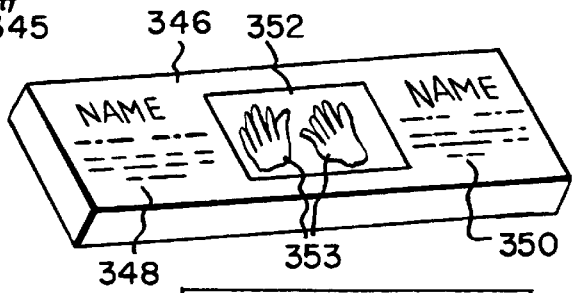
FIG. 130.
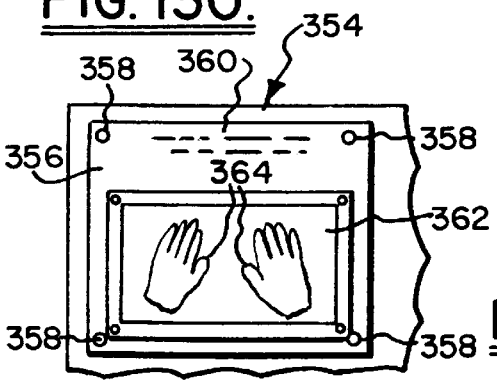
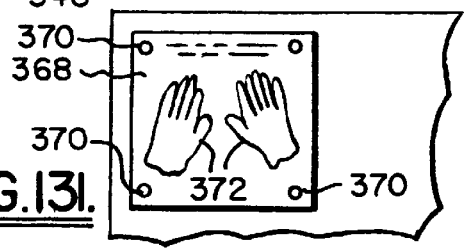
FIG. 131.

MONUMENTS, MARKERS AND COLULMBARIUIMS WITH IMPROVED DISPLAY INDICIA

CROSS-REFERENCE TO RELATED PATENT APPLICATIONS

This application is a continuation-in-part of applicant's copending U.S. application Ser. No. 08/630,114, filed on Apr. 8, 1996, now U.S. Pat. No. 5,622,014, which is a continuation-in-part of U.S. application Ser. No. 08/149,050, filed on Nov. 8, 1993, now U.S. Pat. No. 5,517,791.

FIELD OF THE INVENTION

The field of the present invention is monuments and markers for graves and columbariums for holding urns containing cremated remains. More particularly, the invention pertains to monuments, markers and columbariums containing elements disposed thereon or therein for displaying information. Still more particularly, the invention involves monuments, markers and columbariums having unique elements mounted thereon or therein bearing a verbal message or a non-verbal image that conveys information, particularly about a deceased individual.

BACKGROUND OF THE INVENTION

A first aspect of this invention pertains to grave monuments containing components that perform an information-bearing or decorative function rather than a structural function. Grave monuments which contain non-structural elements are well known to those skilled in the art. Thus, by way of illustration and not limitation, reference may be had to U.S. Pat. No. D259,369 of Splendora (which discloses a transparent monument containing a decorative object within it), U.S. Pat. No. D310,419 of Morvant (which discloses a permanent photographic memorial marker), and U.S. Pat. No. 3,938,286 of Mochinski (which discloses a grave marker comprised of a LUCITE (TM) block), U.S. Pat. No. 3,962,836 of Carnes et al. (which discloses a grave marker with a transparent cover), U.S. Pat. No. 4,058,940 of McBrayer (which discloses a monument marker comprised of a clear plastic outer laminate), U.S. Pat. No. 4,202,144 of Patterson (which discloses a cemetery monument), U.S. Pat. No. 4,227,325 of Whitford (which discloses a grave marker comprised of a cylindrical chamber within which is mounted a picture), U.S. Pat. No. 4,259,381 of Narita (which discloses an ornament for burial monuments which contains a transparent body), U.S. Pat. No. 4,304,076 of Splendora (which discloses a transparent monument), U.S. Pat. No. 4,337,109 of Narita (which discloses a process for preparing a burial ornament), U.S. Pat. Nos. 4,428,168 and 4,428,169 of Tomer (which disclose a permanent floral decoration for use on grave sites), U.S. Pat. No. 4,550,537 of Smith (which discloses a grave monument), and the like. The disclosure of each of these United States patents is hereby incorporated by reference into this patent application.

To the best of applicant's knowledge, very few of the prior art publications relating to monuments disclose monuments with one or more movable elements affixed to them. Disclosures of such monuments may be found in U.S. Pat. No. 4,455,772 of Miller (which discloses a monument comprised of a sliding transparent panel), U.S. Pat. No. 4,463,527 of Schlosser (which discloses a grave marker with a removable cover), and U.S. Pat. No. 5,014,472 of Svensson (which discloses a tombstone with a openable inscription plate).

None of the prior art references discloses a monument with a movable element which can, at the option of the visitor, display selected portions of a relatively large amount of text information.

To the best of applicant's knowledge, there are also no prior art publications that disclose information-bearing elements for monuments that display other than text information or sculpted relief images.

It is an object of this invention to provide a monument with a rotatable element.

It is another object of this invention to provide a monument with a movable element which can display a relatively large amount of information such as text.

It is another object of this invention to provide a monument with an interactive movable element which requires a visitor to move such element to have all of its contents fully disclosed to him or her.

It is another object of this invention to provide a monument with a movable element, which contains a substantially large amount of usable information-bearing surface area.

A second aspect of this invention pertains to columbariums. Columbariums provide long term storage for urns holding cremated human remains. Typical columbariums are disclosed, e.g., in U.S. Pat. Nos. 4,614,066 and 5,195,812.

Columbariums generally have a number of small holding chambers, also known as niches, which each hold an urn and sometimes more than one urn. The niches are generally arranged in banks and with stone facing added to create a dignified appearance.

To the best of applicant's knowledge, none of the prior art publications relating to columbariums disclose columbariums with one or more movable elements affixed to them. Nor does the prior art disclose columbariums with one or more movable elements that are recessed so as not to extend beyond the front face of the columbarium.

It is an object of this invention to provide a columbarium with a rotatable element.

It is a further object of this invention to provide a columbarium with a rotatable element that is recessed so as not to extend beyond the front face of the columbarium.

A third aspect of the invention pertains to monuments, markers and columbariums which display non-verbal information. Such structures are known in the art but the non-verbal indicia are usually formed as sculpted relief images.

It is an object of this invention to provide monuments, markers and columbariums that display non-verbal imprinted images made by casting a shape.

It is a further object of this invention to provide monuments, markers and columbariums that display imprinted images made by casting body parts such as hands, feet, etc. of a deceased individual.

A fourth aspect of this invention pertains to metallic markers such as those that are designed to mount flush to the ground. A limitation of prior art designs is that only a limited amount of information can be cast into such markers do to the nature of the casting process.

It is an object of this invention to provide an improved metallic marker that is adapted for displaying both summary information and more detailed information than would be possible using prior art casting techniques.

SUMMARY OF THE INVENTION

In a first aspect of the invention, a monument is shown having a movable element mounted in an opening therein for displaying information. The movable element may be partially or fully recessed in the opening but is constructed so as to be accessible for manual movement to change the information displayed. In a second aspect of the invention, a columbarium niche structure is shown having a movable element positioned behind an opening in a door. The movable element is preferably recessed so that no portion thereof extends beyond the front face of the door, but is constructed so as to be accessible for manual movement to change the information displayed. An adjustment system is provided for aligning the movable element with the door opening, and a bearing system is used to facilitate positioning of the movable element relative to the door opening. In a third aspect of the invention, grave markers, columbarium niches and monuments are shown which display both text information and imprints of items of interest, such as one or more body parts of a deceased individual. In a fourth aspect of the invention, a flush mounted metallic grave marker displays summary information about a deceased individual and includes additional structure for displaying more detailed information which cannot be readily formed on the surface of the metallic marker.

BRIEF DESCRIPTION OF THE DRAWING

The present invention will be more fully understood by reference to the following detailed description thereof, when read in conjunction with the attached drawings, wherein like reference numerals refer to like elements, and wherein:

FIG. 34 is a front view of another preferred embodiment of a monument of this invention.

FIG. 35 is side view of the monument of FIG. 34.

FIG. 36 is a rear view of the monument of FIG. 34.

FIG. 37 is a sectional view of the monument of FIG. 34.

FIG. 38 is a plan view of the monument of FIG. 34.

FIG. 39 is a front view of another preferred embodiment of a monument of this invention.

FIG. 40 is side view of the monument of FIG. 39.

FIG. 41 is a rear view of the monument of FIG. 39.

FIG. 42 is a sectional view of the monument of FIG. 39.

FIG. 43 is another sectional view of the monument of FIG. 39.

FIG. 44 is a front view of another preferred embodiment of a monument of this invention.

FIG. 45 is side view of the monument of FIG. 44.

FIG. 46 is a plan view of the monument of FIG. 44.

FIG. 47 is a rear view of the monument of FIG. 44.

FIG. 48 is a sectional view of the monument of FIG. 44.

FIG. 49 is a sectional view of the monument of FIG. 44.

FIGS. 106 through 121 are perspective views of various fasteners which can be used with the columbarium of FIG. 101.

FIG. 123 is a partial perspective view of another preferred columbarium of the invention in which a movable information-bearing element is recessed so as not to extend beyond the front face of the columbarium.

FIG. 124 is a cross-sectional view taken along line 124—124 in FIG. 123.

FIG. 125 is a cross-sectional view taken along line 125—125 in FIG. 124.

FIG. 126 is a cross-sectional view taken along line 126—126 in FIG. 125.

FIG. 127 is a cross-sectional view showing an alternative construction to the cross-sectional view of FIG. 125.

FIG. 128 is a perspective view of a grave marker constructed in accordance with another aspect of the invention.

FIG. 129 is a perspective view of a grave marker constructed in accordance with another aspect of the invention.

FIG. 130 is a perspective view of a columbarium niche constructed in accordance with another aspect of the invention.

FIG. 131 is a perspective view of a columbarium niche constructed in accordance with another aspect of the invention.

FIG. 133 is a perspective view of a pedestal monument constructed in accordance with another aspect of the invention.

FIG. 134 is a plan view of a grave marker constructed in accordance with another aspect of the invention.

FIG. 135 is a cross-sectional view taken along line 135—135 in FIG. 134.

DETAILED DESCRIPTION OF THE PREFERRED EMBODIMENTS

In the first part of this specification, applicant will describe her novel monument with a movable element. In the second part of this specification, applicant will describe her novel columbarium with a movable element. In a third part of the specification, applicant will describe her novel monuments, markers and columbariums with imprinted images made by casting. In a fourth part of the specification, applicant will describe her novel metallic marker that displays both summary and detailed information.

Monument With Movable Element

Figure 1:
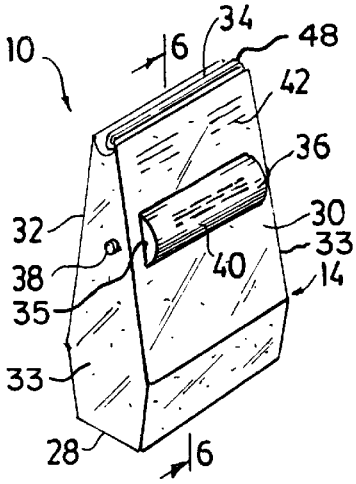
FIG. 1 is a perspective view of one preferred embodiment of a monument of this invention.

FIG. 1 is a perspective view of one preferred monument 10 of this invention. As is known to those skilled in the art, a monument is an inscribed stone or other marker erected as a memorial.

Such monuments are well known to those skilled in the art. Thus, e.g., reference may be had to U.S. Pat. No. 3,938,286, which discloses an integral body having a generally upright member with a top and bottom and having a decorative exterior bearing identifying indicia. Thus, e.g., reference may be had to U.S. Pat. Nos. 3,962,836, 945,721, and 2,046,594, each of which discloses grave markers (such as those constructed of such relatively expensive materials such as bronze, brass, silver, and the like) and/or composite grave markers which include a transparent exterior member. Thus, e.g., reference also may be had to U.S. Pat. Nos. 4,058,940 and 2,124,143, which disclose grave markers constructed either from natural stone (such as granite) or man-made materials (such as acrylic plastic). Thus, e.g., reference also may be had to U.S. Pat. No. 4,169,970, which discloses tombstones and memorial monuments. Thus, e.g., reference also may be had to U.S. Pat. No. 4,202,144, which discloses a cemetery monument that includes a base and a main body section extending upwardly from the base, wherein such body section includes an outer shell formed of a plurality of textured, corrosion-resistant metal panels. Thus, reference also may be had to U.S. Pat. No. 4,227,325, which discloses a grave marker having a base, a marker, and a chamber for displaying pictures, photographs and the like. Reference may also be had to U.S. Pat. No. 4,304,076, which describes a monument comprising a single, unitary, substantially transparent molded member. Thus, e.g., reference may also be had to U.S. Pat. No. 4,550,537, which describes a monument consisting of a head and a base, both of which consist of stainless steel. Reference also may be had to U.S. Pat. Nos. 4,202,144, 4,009,547 (monument base), U.S. Pat. Nos. D243,466, 5,014,472, 3,857,214 (method of making tombstones), U.S. Pat. No. 3,481,089 (memorial marker with removable indicia), U.S. Pat. No. 3,477,181 (tombstone frames), and the like. The disclosure of each of these United States patents is hereby incorporated by reference into this specification.

In one preferred embodiment, illustrated in FIGS. 1–6, the monument 10 of this invention is constructed with a base 12 and a body 14. Any conventional arrangement for supporting body 14 of monument 10 may be used. Thus, by way of illustration and not limitation, one may use one or more of the concrete anchor arrangements well known to those skilled in the art. For example, one may use the devices illustrated in U.S. Pat. No. 5,107,650 (concrete anchors), U.S. Pat. Nos. 5,074,095, 5,063,724 (anchor for fixing a rod in concrete), U.S. Pat. Nos. 5,049,015, 4,872,298, and the like. The disclosure of each of these United States patents is hereby incorporated by reference into this specification.

Figure 2:
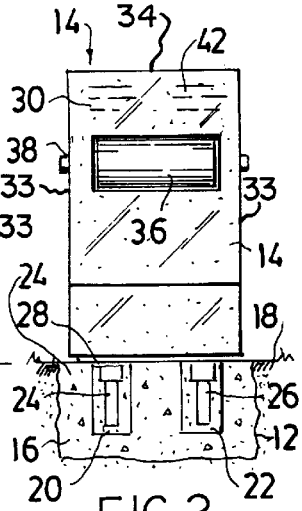
FIG. 2 is a front view of the monument of FIG. 1.
Figure 7:
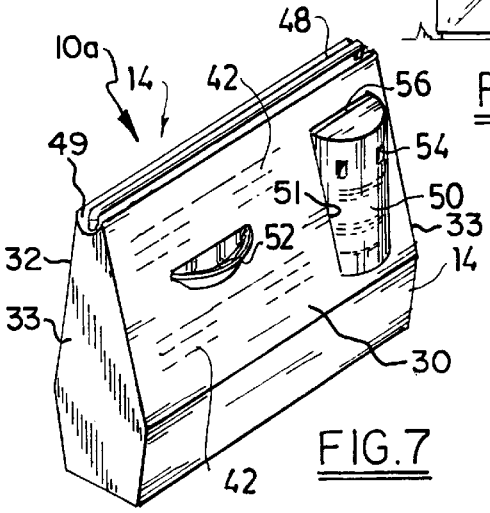
FIG. 7 is a perspective view of another preferred embodiment of a monument of this invention.
Figure 11:
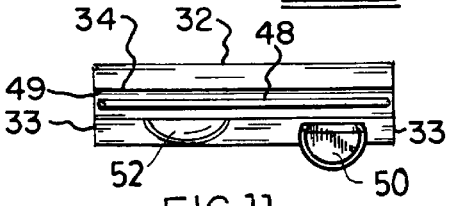
FIG. 11 is a plan view of the monument of FIG. 7.
Figure 10:
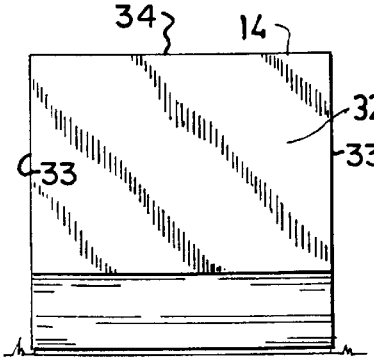
FIG. 10 is a rear view of the monument of FIG. 7.
Figure 9:
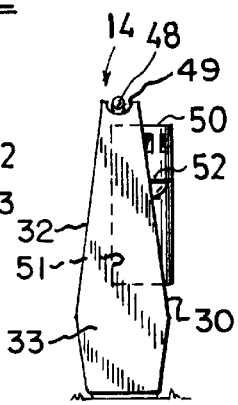
FIG. 9 is side view of the monument of FIG. 7.
Figure 8:
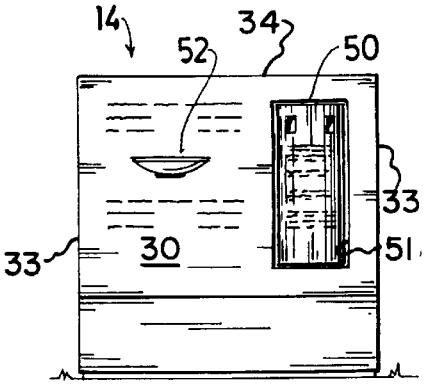
FIG. 8 is a front view of the monument of FIG. 7.

Referring to FIG. 2, and in the preferred embodiment illustrated therein, it will be seen that the body 14 is mounted on a concrete foundation 16 which is disposed within the ground 18. This mounting arrangement is well known to those skilled in the art. Thus, e.g., one may dig a suitable hole in the ground 18, and pour concrete within such hole. Appropriate forms are used such that when the concrete hardens, it fills all of such hole except for recesses 20 and 22. These recesses are adapted to receive steel anchors 24 and 26 which are attached to the bottom surface 28 of the body 14. The body 14 with its attached steel anchors 24 and 26 is disposed so that anchors 24 and 26 are within recesses 20 and 22. The recesses may be filled with wet concrete prior to the time the steel anchors 24 and 26 are inserted therein, or they may be filled with wet concrete thereafter. In either event, once the concrete within the recesses 24 and 26 hardens, a substantially permanent attachment for mounting the body 14 to the ground 18 is formed. As will be apparent to those skilled in the art, this is but one way of durably mounting the body 14 on the ground 18.

As shown in FIGS. 1–6, and in the preferred embodiment illustrated therein, it will be seen that the body 14 is an upwardly extending structure which is formed with a bottom 28, a front face 30, a rear face 32, a pair of sides 33, and a top 34. It will be apparent to those skilled in the art that, although the applicant has illustrated certain preferred shapes which may be used for the body 14 of the monument 10, substantially any shape may be used.

The body 14, and/or the base 12, may consist essentially of any natural or manmade material. Thus, e.g., the body 12 may be constructed from granite, concrete and/or other ceramic material, stainless steel, acrylic, composite materials composed of filler and matrix, and the like.

As shown in FIGS. 1–6, disposed within at least one surface of the body 14 is a partially cylindrical recess 35 adapted to receive a rotatable cylinder 36. In the embodiment illustrated in FIGS. 1–6, the rotatable cylinder 36 is securely mounted on a shaft 37 (see FIG. 6) which extends through the longitudinal axis of the cylinder and is rotatably mounted by bearings or the like in a pair of small apertures extending through in the sides 33 of the body 14. The shaft 37 is preferably sized to extend through the apertures in the sides 33 and may be moved (i.e., rotated) by means of a knob 38 mounted on one or both ends of thereof. By rotating the knob(s) 38, the rotatable cylinder 36 may be rotated by a visitor to the monument.

As shown in FIG. 1, the rotatable cylinder 36 preferably has an inscription 40 on its circumferential surface. As the cylinder 36 is rotated, the text of such inscription is gradually revealed by and to the visitor.

The rotatable cylinder 36 preferably is relatively lightweight and may be constructed, e.g., from copper, stainless steel, aluminum, bronze, plastic, titanium, and any other material which will provide a reasonable amount of chemical and weather resistance. The inscription 40 on the surface of cylinder 36 may be made by conventional methods such as, e.g., engraving, relief printing, stamping, printing, acid wash, etc. In the preferred embodiment, the rotatable cylinder 36 contains a hollow interior to decrease its weight and reduce the cost of materials.

As shown in FIGS. 1 and 2, it will be seen that the front face 30 of the monument 10 preferably includes an inscription 42 describing information such as the name, birthplace, birth date, death place, and death date of the deceased.

Figure 6:
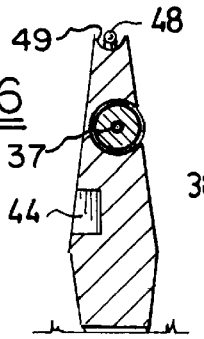
FIG. 6 is a sectional view of the monument of FIG. 1.
Figure 5:
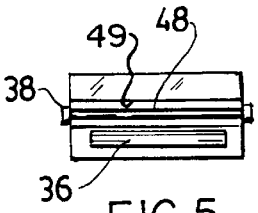
FIG. 5 is a plan view of the monument of FIG. 1.
Figure 4:
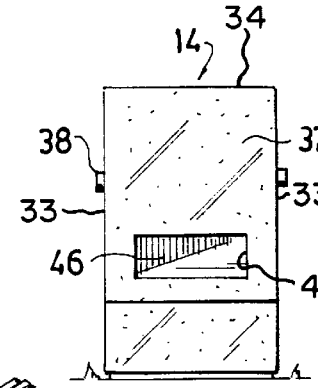
FIG. 4 is a rear view of the monument of FIG. 1.
Figure 3:
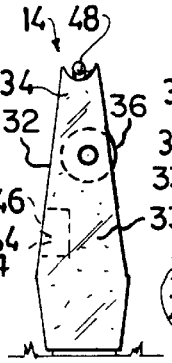
FIG. 3 is a side view of the monument of FIG. 1.

As shown in FIGS. 3, 4 and 6, it will be seen that the monument 10 may also be formed with a rear compartment 44 which is enclosed by a movable, lockable door 46. It will also be noted that, in this embodiment, a decorative rod 48 (which is preferably made from metal) may be disposed in a partially cylindrical recess 49 formed in the top surface 34 of the body 14.

FIGS. 7–11 illustrate another preferred embodiment in which a monument **10*a* is constructed in similar fashion to the monument of the previous embodiment, and wherein like reference numbers represent like structure in each of the several views. Unlike the monument 10 of FIGS. 1–6, the monument 10*a* of FIGS. 7–11 does not have a horizontal rotatable cylinder 36. Rather, the body 14 of the monument 10*a* is fitted with an upwardly extending rotatable cylinder 50 having an inscription thereon. The rotable cylinder 50 is mounted in a partially cylindrical recess 51 formed in the front face 30 of the body 14. It is supported on a vertical shaft (not shown) extending through at least the bottom of the rotable cylinder 50 along the cylindrical axis thereof. The vertical shaft is in turn mounted to the body 14 at least at the lower end of the shaft (not shown). A rotatable connection is provided between the shaft and the body 14, or between the shaft and the rotatable cylinder 50, to permit the cylinder to be rotated by a visitor. The monument 10*a* further includes a horizontally extending receptacle 52 affixed to the front face 30 of the body 14. The receptacle 52 is adapted to support a candle (not shown), a plant (not shown), and/or other article(s). The receptacle 52 may consist essentially of stone, metal, concrete, or any other suitable building material. In the embodiment illustrated in FIGS. 7–11, the cylinder 50 is provided with recessed pulls 54 and 56 (and, optionally, other recessed pull(s) not shown) which allow a visitor to more readily rotate the cylinder 50** to read the inscription thereon.

FIGS. 12–17 illustrate another preferred embodiment in which a monument **10*b* is constructed in similar fashion to the monuments of the previous embodiments, and wherein like reference numbers represent like structure in each of the several views. Unlike the monuments 10 and 10*a*, the monument 10*b* of FIGS. 12–17 does not have a rotatable cylinder. Rather, a multi-directional sphere 58 is rotatably mounted by a suitable bearing arrangement within a partially spherical recess 59 formed in the body 14. As will be apparent to those skilled in the art, in order to rotatably secure the sphere 58 within the recess 59, it is advantageous to construct the body 14 in two pieces from a top portion 60 and a bottom portion 62 which may be joined to each other by conventional methods. The top portion 60 and the bottom portion 62 are configured to form the recess 59 when joined together. The recess 59 preferably extends through the front face and the rear face 32 of the body 14 such that the sphere 58 protrudes through both faces. The sphere contains a suitable inscription on its exterior surface. It will be apparent that a substantial amount of, or all of, the exterior surface of the rotatable sphere 58 may have the inscription applied to it. It will also be apparent that, because the recess 59 extends from the front face 30 to the rear face 32 of the body 14, a visitor may read such inscription from either the front or the back of the monument 10***b*.

Although a rotatable sphere 58 is illustrated in FIGS. 12–17, it will be apparent that other rotatable, arcuate shapes may also be used. Thus, e.g., one may use a rotatable ovoid (not shown). Alternatively, one may use a rotatable irregularly shaped object, or a rotatable polygonal object with multiple, e.g., five or more, faceted sides.

The rotatable sphere 58 may consist essentially of any of the durable, relatively weather resistant materials described elsewhere in this specification such as, e.g., concrete, stone, plastic, bronze, stainless steel, aluminum, and the like. Some or all of the surface of the sphere 58 may be inscribed in the manner disclosed elsewhere in this specification.

Figure 12:
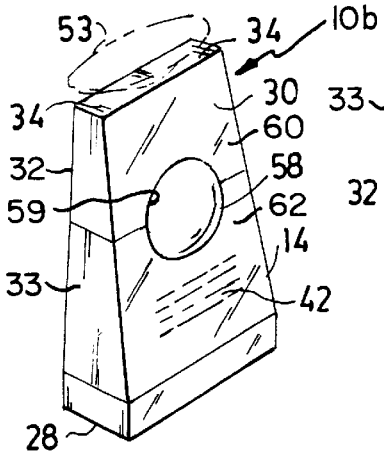
FIG. 12 is a perspective view of another preferred embodiment of a monument of this invention.
Figure 16:
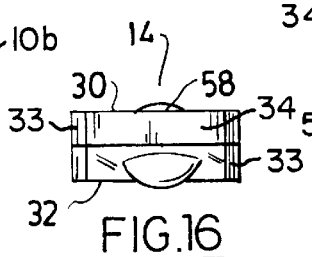
FIG. 16 is a plan view of the monument of FIG. 12.
Figure 17:
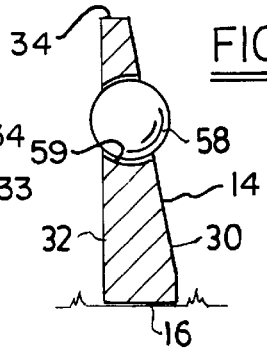
FIG. 17 is a sectional view of the monument of FIG. 12.
Figure 15:
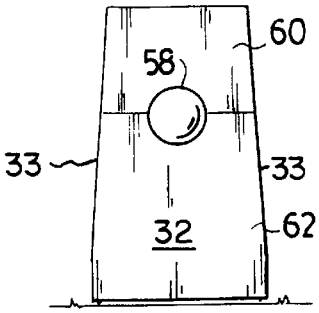
FIG. 15 is a rear view of the monument of FIG. 12.
Figure 14:
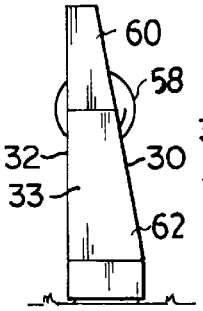
FIG. 14 is side view of the monument of FIG. 12.
Figure 13:
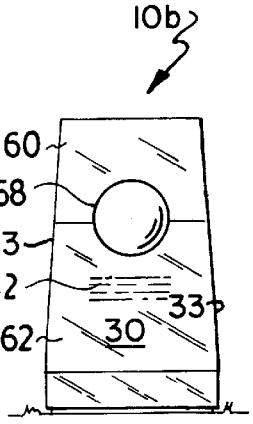
FIG. 13 is a front view of the monument of FIG. 12.
Figure 18:
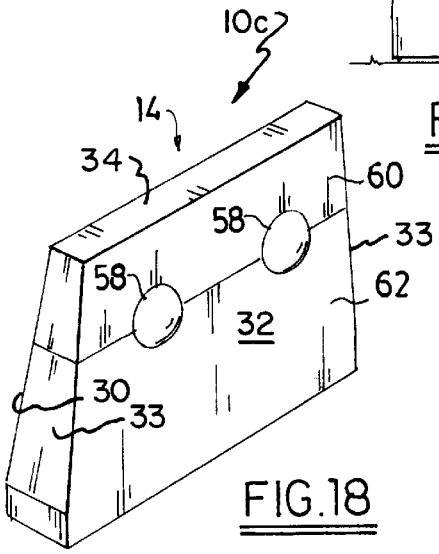
FIG. 18 is a rear perspective view of another preferred embodiment of a monument of this invention.
Figure 22:
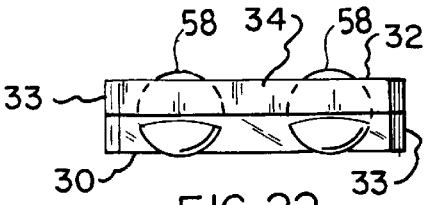
FIG. 22 is a plan view of the monument of FIG. 18.
Figure 21:
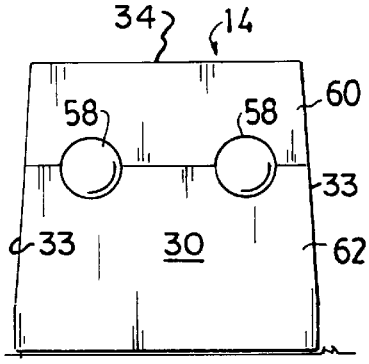
FIG. 21 is a rear view of the monument of FIG. 18.
Figure 20:
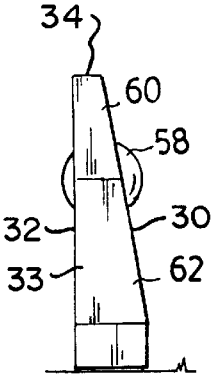
FIG. 20 is side view of the monument of FIG. 18.
Figure 19:
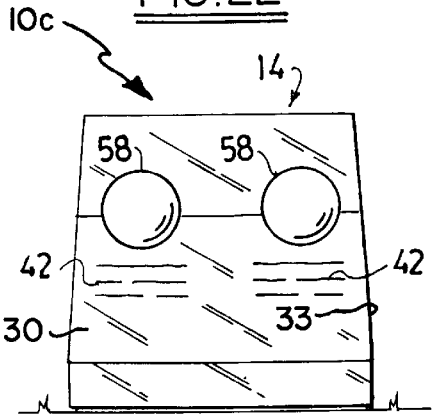
FIG. 19 is a front view of the monument of FIG. 18.
Figure 23:
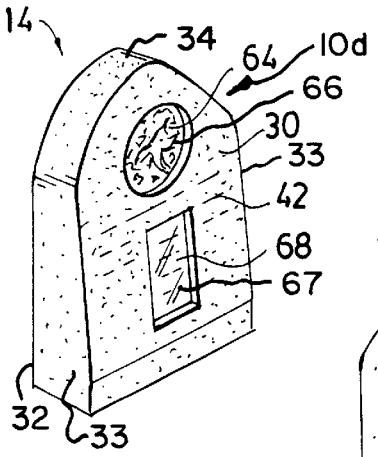
FIG. 23 is a perspective view of another preferred embodiment of a monument of this invention.
Figure 27:
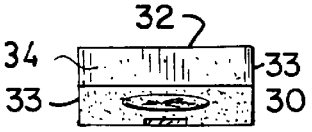
FIG. 27 is a plan view of the monument of FIG. 23.
Figure 26:
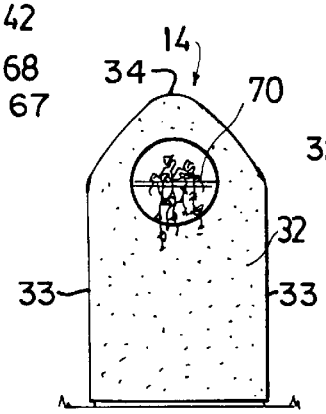
FIG. 26 is a rear view of the monument of FIG. 23.
Figure 25:
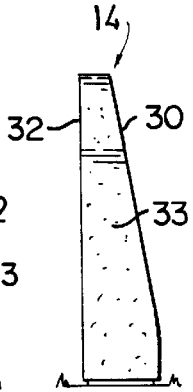
FIG. 25 is side view of the monument of FIG. 23.
Figure 24:
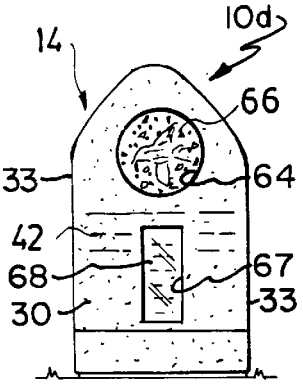
FIG. 24 is a front view of the monument of FIG. 23.
Figure 28:
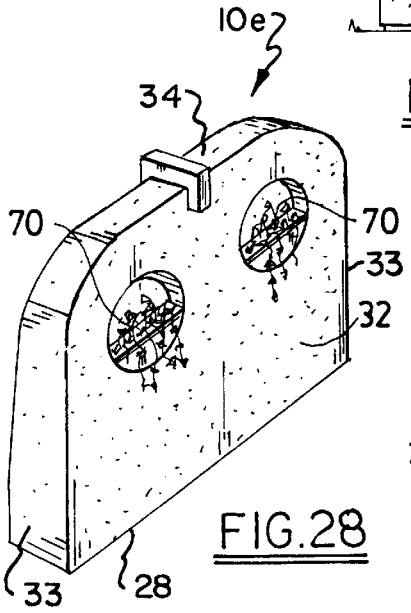
FIG. 28 is a rear perspective view of another preferred embodiment of a monument of this invention.
Figure 33:
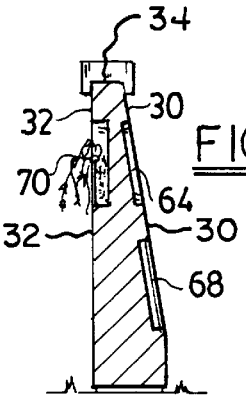
FIG. 33 is a sectional view of the monument of FIG. 28.
Figure 32:
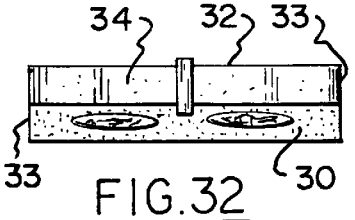
FIG. 32 is a plan view of the monument of FIG. 28.
Figure 31:
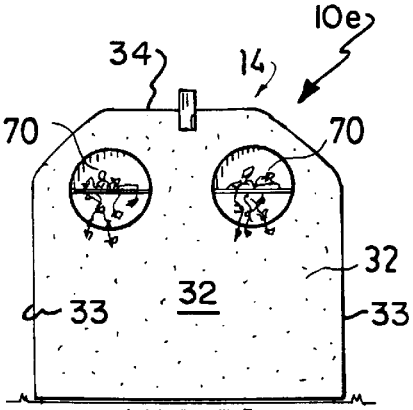
FIG. 31 is a rear view of the monument of FIG. 28.
Figure 30:
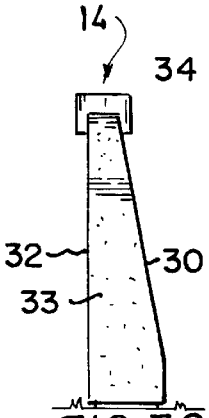
FIG. 30 is side view of the monument of FIG. 28.
Figure 29:
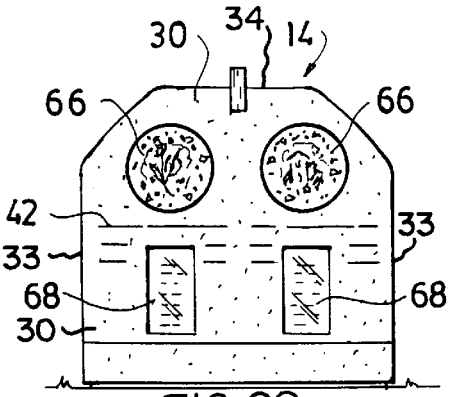
FIG. 29 is a front view of the monument of FIG. 28.
Figure 50:
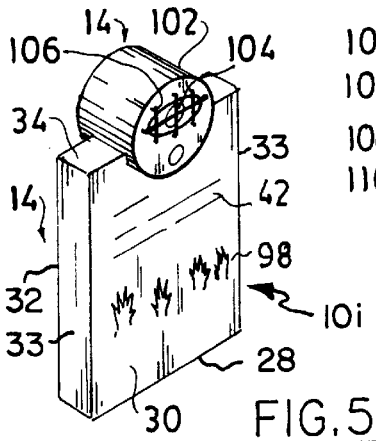
FIG. 50 is a front perspective view of another preferred embodiment of the monument of this invention.

As shown in FIGS. 12, and in the preferred embodiment illustrated therein, it will be seen that a bowl 59 can be mounted on the top surface 34 of the body 14. The bowl 59 may be constructed from any relatively durable material such as, e.g., stainless steel, granite, plastic, concrete, and the like.

FIGS. 18–22 illustrate another preferred embodiment in which a monument 10*c* is constructed in similar fashion to the monuments of the previous embodiments, and wherein like reference numbers represent like structure in each of the several views. The monument 10*c* is similar to the monument 10*b* except that it includes two rotatable spheres 58. Again, to rotatably support the spheres 58 in a secure manner, the body 14 is preferably constructed from a top portion 60 and a bottom portion 62 which are joined to each other by conventional methods to form a recess in which the spheres are supported for rotation. An suitable bearing arrangement is preferably used to facillitate rotation of the spheres 58 by visitors.

FIGS. 23–27 illustrate another preferred embodiment in which a monument 10*d* is constructed in similar fashion to the monuments of the previous embodiments, and wherein like reference numbers represent like structure in each of the several views. Unlike the previous embodiments that included movable elements, the front face 30 of the body 14 of this embodiment is formed with a substantially circular recess 64 adapted to receive a mosaic 66 (see FIG. 24). As will be apparent to those skilled in the art, different mosaic designs may, at the option of the purchaser of the monument, be installed and/or removed from the recess 64.

As shown in FIGS. 23–27, it will be seen that the body 14 also preferably includes a second recess 68 adapted to receive a metal plate 68 which may contain a suitable inscription. In addition, it will be seen that the back face 32 of the body 14 is preferably formed with a third recess 70 which is adapted to receive, e.g., a plant, a mosaic, a candle, or other suitable object(s).

FIGS. 28–33 illustrate another preferred embodiment in which a monument 10*e* is constructed in similar fashion to the monuments of the previous embodiments, and wherein like reference numbers represent like structure in each of the several views. The monument 10*e* is similar to the monument 10*d* except that there are two recesses 70 on the rear face 32 of the body 14. Each recess 70 is adapted to receive one or more of the objects described above.

FIGS. 34–49 disclose three embodiments in which monuments are constructed from a multi-layered laminated structure which, depending on the extent it is cut away, will reveal different surface materials and appearances.

FIGS. 34–37 illustrate a monument 10*f* in which the front face 30 of the body 14 is constructed from a first metal layer (not shown) and a second, different metal layer (not shown). The front face 30 is formed with a hole 72 and a recess 74. A plate 76 (shown in FIG. 37) may be attached within the hole 72, preferably on its bottom horizontal surface 78. Alternatively, or additionally, a bowl or other decorative object (not shown) may be attached within the hole 72 on the bottom horizontal surface 78 thereof. A plate 79 is attached within the recess 74 and preferably bears an inscription providing information about the deceased.

FIG. 37 illustrates one embodiment of a plate 76 which may be attached within the hole 72. This plate may contain an impression of the hands 80 and 82 of the deceased and/or other another person(s) and/or other objects. It may also contain, e.g., recesses 84 and 86 for candles (not shown). Tinted glass or plastic pieces 88 may be used to separate the recesses 84 and 86 from the impressions 80 and 82. As will be apparent to those skilled in the art, the deeper the recesses 80 and/or 82 are, the more striated an appearance such recesses will present.

The embodiment depicted as monument 10*g* in FIGS. 39–43 is similar to the embodiment of FIGS. 34–38 with the exception that (1) the back face 32 is provide with an additional lockable recess compartment 44 and a door 46, and (2) the decorative plate 78 is formed with a bowl-shaped recess 90.

The embodiment depicted as monument 10*h* in FIGS. 44–49 is similar to the embodiments of FIGS. 34–43 with the exception that (1) two front recesses 74 are provided which are adapted to receive a metal plate 79, (2) each of the recesses 74 may have a different depth and, thus, present a different appearance, (3) the top surface 34 of the body 14 is formed with a recess 92 adapted to receive a planter 94, and (4) a drain hole 96 is disposed in the back surface 32 of the body 14 and is adapted to remove water from planter 94.

FIGS. 50–58 illustrate another preferred embodiment in which the body 14 of a monument 10*i* includes a front face 30 in which impressions 98 of the hands of a deceased individual, or embedded objects 100 (such as, e.g., seashells or rocks) are disposed within such front face 30. The top wall 34 of the body 14 is comprised of a recess 97 in which is disposed a chamber 102 which, preferably, is hollow in order to contain a document within its hollow interior, and includes a magnifying lens 104 preferably protected by a metal grid 106. The lens 104 allows a visitor to more readily view the document within the chamber 102.

Figure 55:
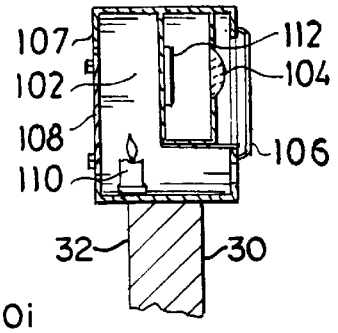
FIG. 55 is a sectional view of the monument of FIG. 50.
Figure 54:
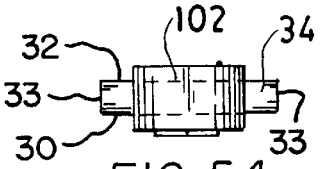
FIG. 54 is a plan view of the monument of FIG. 50.
Figure 53:
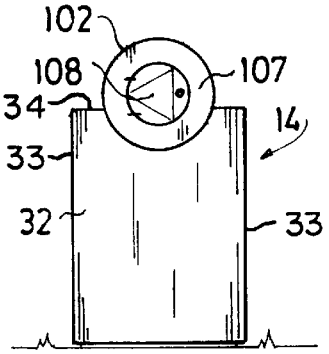
FIG. 53 is a rear view of the monument of FIG. 50.
Figure 52:
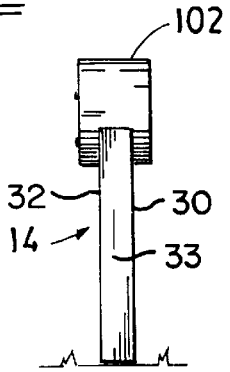
FIG. 52 is side view of the monument of FIG. 50.
Figure 51:
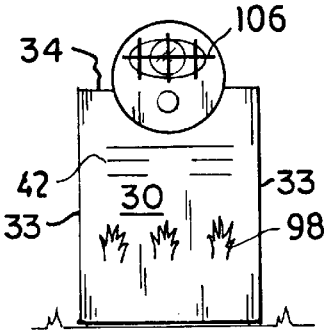
FIG. 51 is a front view of the monument of FIG. 50.

FIG. 55 illustrates one preferred embodiment of the chamber 102 in which the back wall 107 of such chamber contains a door 108 which may be opened to allow a candle 110 to be placed within such chamber. A document 112 may be viewed by placing one's eye near or next to the magnifying lens 104.

Figure 56:
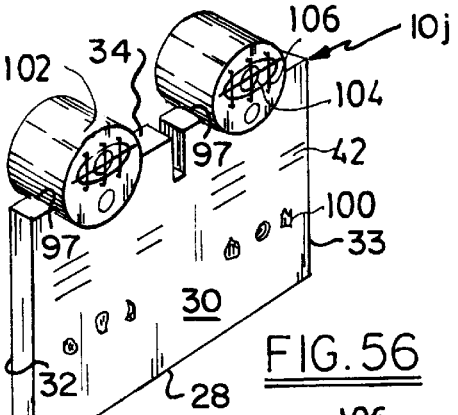
FIG. 56 is a perspective view of another preferred embodiment of the monument of this invention.
Figure 59:
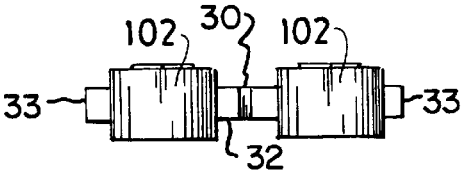
FIG. 59 is a plan view of the monument of FIG. 56.
Figure 57:
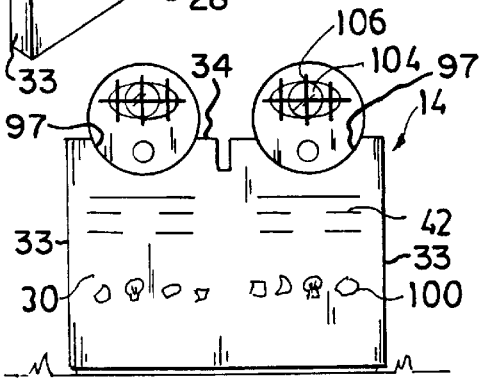
FIG. 57 is a front view of the monument of FIG. 56.
Figure 58:
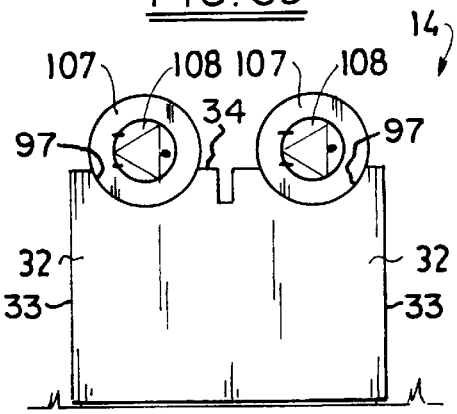
FIG. 58 is a rear view of the monument of FIG. 56.

The embodiment of FIGS. 56–58 is similar to that of FIGS. 50–55 with the exception that the monument 10*j* includes a body 14 having two chambers 104 disposed in a pair of recesses 97 on the top wall 34.

FIGS. 60–73 and 81–83 illustrate embodiments in which the body 14 of a monument has a front face 30 and/or a rear face 32 in which one or more holes is disposed to receive a rectangular or square block which contains inscription(s) on one or more of its exterior surfaces.

Figure 60:
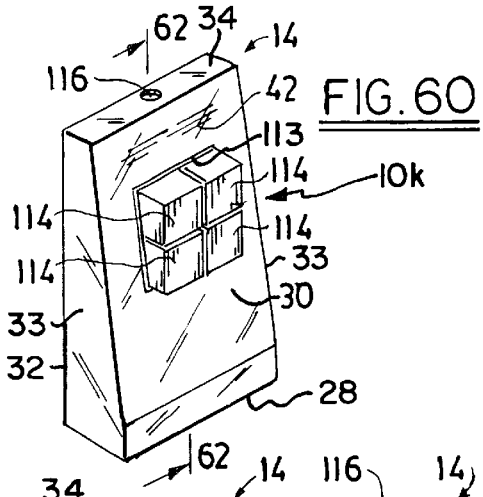
FIG. 60 is a front perspective view of another preferred embodiment of the monument of this invention.
Figure 65:
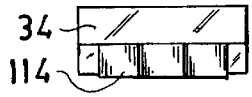
FIG. 65 is a plan view of the monument of FIG. 60.
Figure 64:
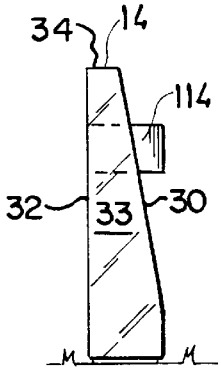
FIG. 64 is a side view of the monument of FIG. 60.
Figure 63:
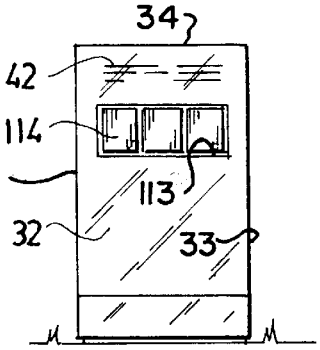
FIG. 63 is a rear view of the monument of FIG. 60.
Figure 61:
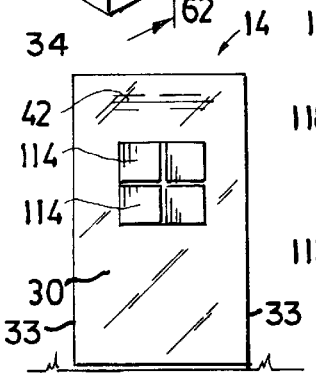
FIG. 61 is a front view of the monument of FIG. 60.
Figure 62:
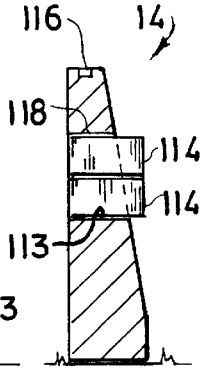
FIG. 62 is a sectional view of the monument of FIG. 60.
Figure 66:
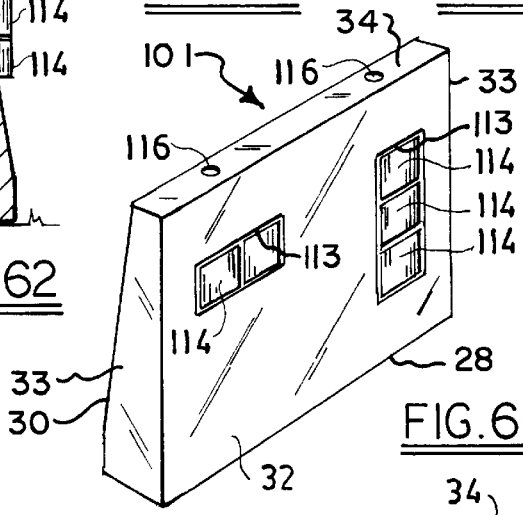
FIG. 66 is a rear perspective view of another preferred embodiment of a monument of this invention.
Figure 68:
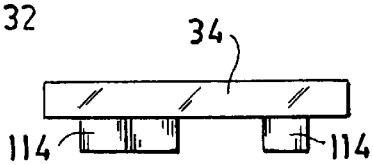
FIG. 68 is a plan view of the monument of FIG. 66.
Figure 69:
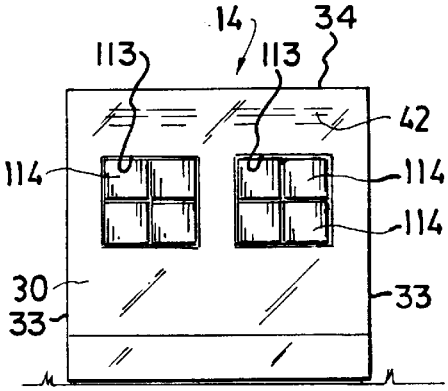
FIG. 69 is a front view of the monument of FIG. 66.
Figure 67:
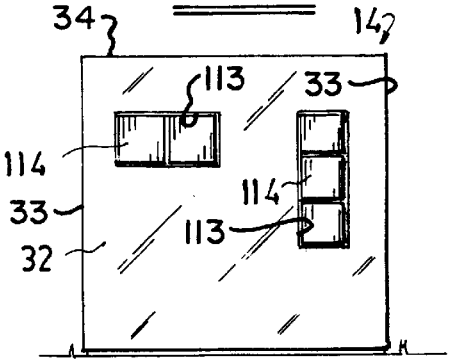
FIG. 67 is a rear view of the monument of FIG. 66.
Figure 72:
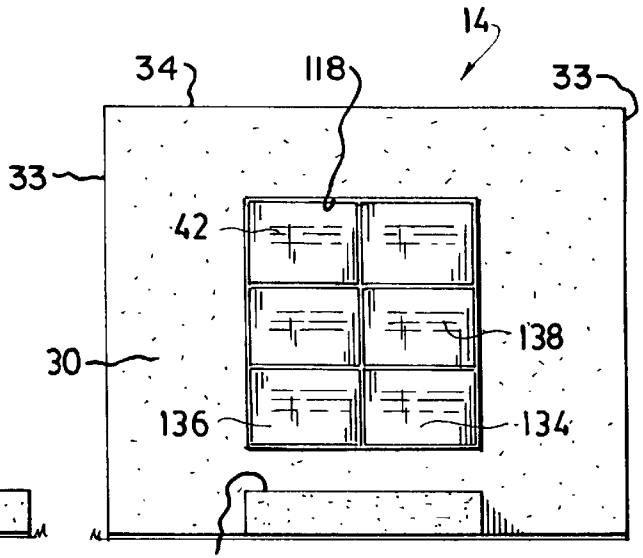
FIG. 72 is a front view of the monument of FIG. 70.

Referring to FIGS. 60–65, it will be seen that the body 14 of a monument 10*k* is formed with an orifice 113 in which one or more blocks 114 are disposed. As will be apparent to those skilled in the art, one or more family members and/or friends may provide a suitable inscription on the surface(s) of the block(s) 114 and insert them within the orifice 113. The blocks may all have a similar texture and appearance, and/or they may have different textures and/or appearances and/or compositions. It will be seen that the top surface 34 of the body 14 includes a hole 116 adapted to receive a candle (not shown). FIG. 62 is a sectional view of the body 14 of FIG. 60 showing that the orifice 113 preferably extends from the front face 30 to the rear face 32 of the body 14.

FIGS. 66–69 depict an embodiment in which the body 14 of a monument 101 is similar to that depicted in FIG. 60 with the exception that two orifices 113 are provided to receive blocks 114. Thus, the embodiment of FIGS. 66–69 may be used as a monument for two people.

FIGS. 70–73 illustrate an embodiment in which the body 14 of a monument 10*m* is similar to that depicted in FIGS. 66–69 in that it can be used as a monument for at least two people. Thus, it will be seen that the rear face 32 of the body 14 is formed with a large, centrally disposed orifice 118 which, as the need arises (by the death of one or more members of the family), may be filled with memory blocks.

Thus, for example, assuming that the husband in the family is the first to die, his wife, daughter, son, and partner may insert memory blocks 120, 122, 124, and 126 in the bottom right hand corner of the orifice 118. These memory blocks may be made out of the same and/or different materials, and they may contain customized inscriptions and/or embedded elements which the particular person preparing such block wishes to present. As will be apparent to those skilled in the art, if only three such people desire to present such memory blocks, then three substantially rectangular blocks (such as blocks 128, 130, and 132) may be disposed in the space reserved for the particular deceased family member.

Figure 71:
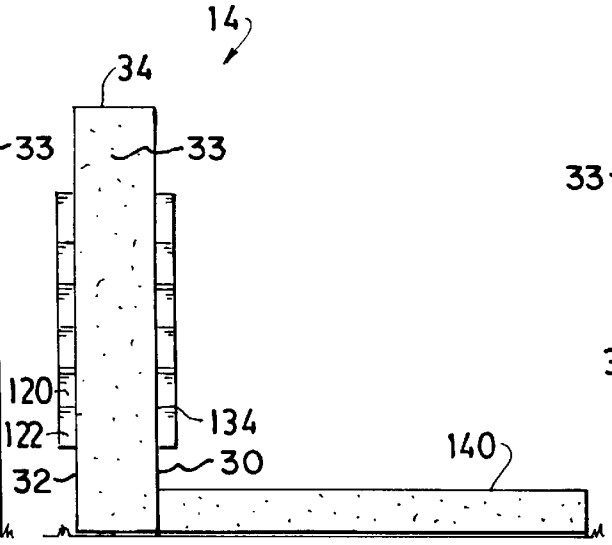
FIG. 71 is a side view of the monument of FIG. 70.
Figure 70:
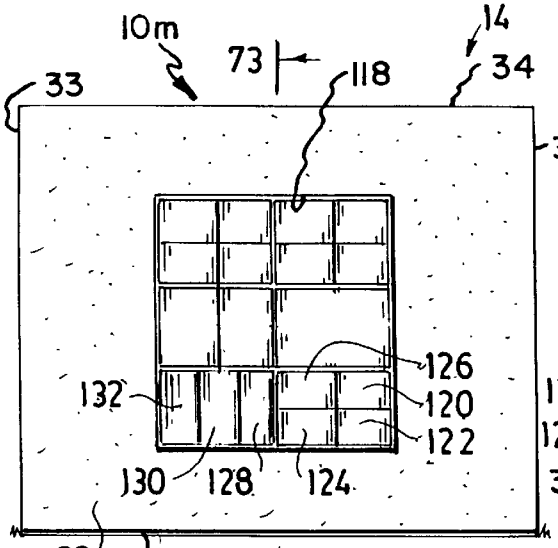
FIG. 70 is rear view of another preferred embodiment of a monument of this invention.
Figure 73:
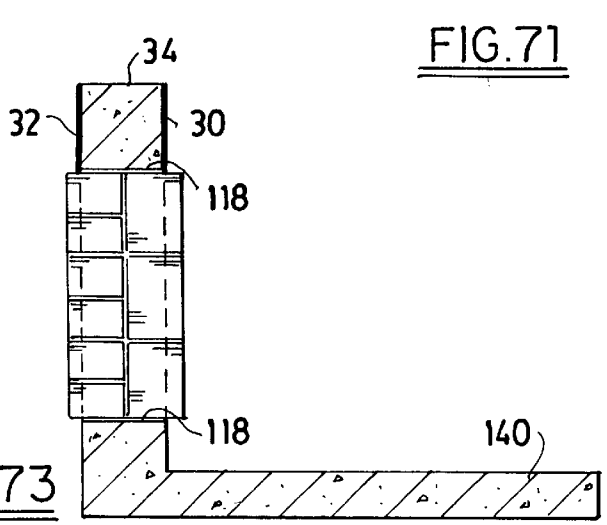
FIG. 73 is a sectional view of the monument of FIG. 70.
Figure 80:
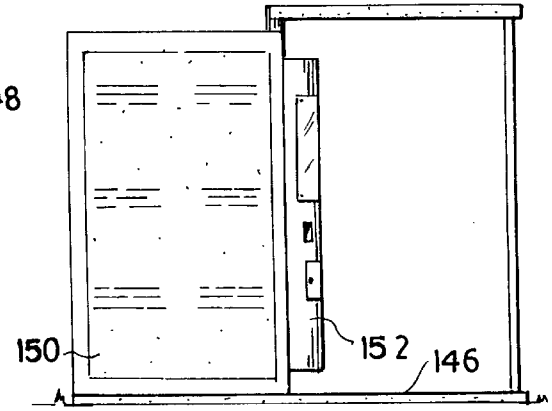
FIG. 80 is a side view of the monument of FIG. 79.

As shown in FIG. 71, a single block 134 may be inserted on the opposing face 30 of the body 14 for such husband, e.g. in the lower right hand corner of the orifice 118 (which preferably extends from the front face 30 to the rear face 32). Thereafter, as the wife in the family dies, and the dog dies, the blocks 136, 138 et seq. may be added.

The single blocks 134 et seq. preferably contain relevant information about the deceased in the form of an inscription 42. Such information may include birthplace, date of birth, date of death, place of death, name, etc.

Thus, by looking first at the front face 30, a visitor may learn some essential facts about the deceased. Thereafter, by looking at the memory blocks in back of the single blocks 134 et seq., the visitor may learn more about the values, beliefs, and accomplishments of the deceased.

As shown in FIG. 71, a stone walkway 140 is provided for the visitor to approach the front face 30 of the body 14.

Figure 74:
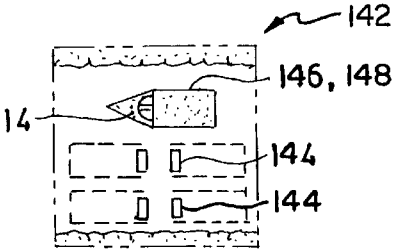
FIG. 74 is a site plan view of another preferred embodiment of a monument of this invention.

FIG. 74 is a site plan of a shelter 142 which includes a body 14 and individual burial plot markers 144. The particular body 14 in such site plan is shown in more detail in FIGS. 75 through 80. As shown in those figures, the shelter 142 has a floor 146, a roof 148, and a body enclosure 150. Disposed within the body enclosure 150 is a rotatable cylinder 152 which is similar to, but substantially larger than, the rotatable cylinder 50 (see FIG. 7). This cylinder 162 is vertically disposed within the body 14, whereas cylinder 36 (see FIG. 1) was horizontally disposed within the body 14.

One preferred embodiment of the cylinder 152 is illustrated in FIGS. 75–79. Referring to such figures, it will be seen that the cylinder 152 preferably is rotatably mounted on a shaft 154 so that such cylinder is suspended between the floor 146 and the roof 148. On the surface 156 of cylinder 152 are affixed one or more plates (such as a metal plate 158) which may be engraved with information about the life and times of the deceased. In one embodiment, one such plate 168 is affixed to the surface 156 of the cylinder 152 for each person buried within the plot.

Figure 77:
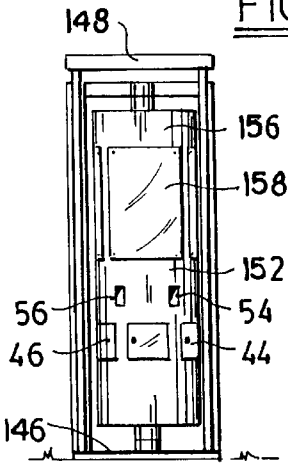
FIG. 77 is a front view of the monument of FIG. 74.

As shown in FIG. 77, it will be seen that the rotatable cylinder 152 also is formed with recessed pulls 54 and 56. In addition, there are one or more lockable compartments 44 equipped with lockable doors 46.

Figure 78:
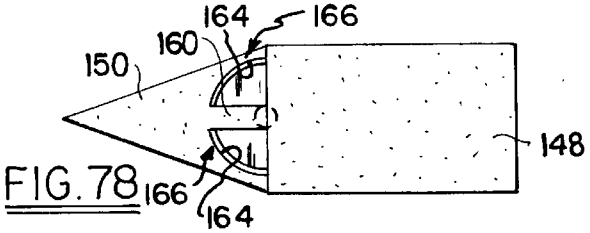
FIG. 78 is a plan view of the monument of FIG. 74.
Figure 79:
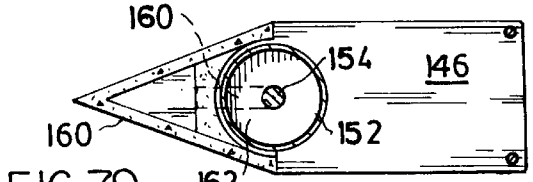
FIG. 79 is a section view of the monument of FIG. 74.
Figure 75:
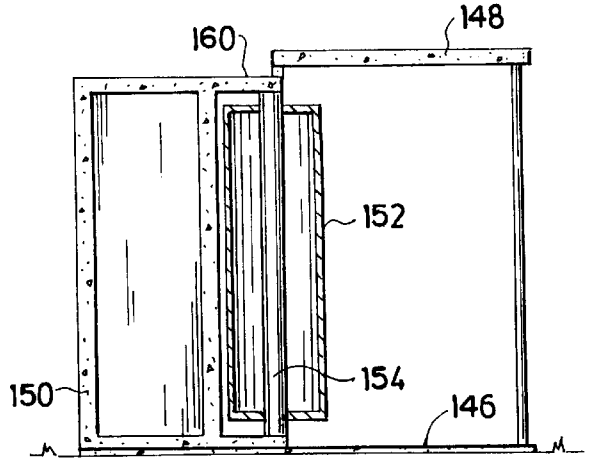
FIG. 75 is a sectional view of the monument of FIG. 74.

As shown in FIGS. 75, 78, and 79, the shaft 154 is preferably connected to the body 150 with a horizontally extending arm 160 which supports such shaft 154.

Figure 76:
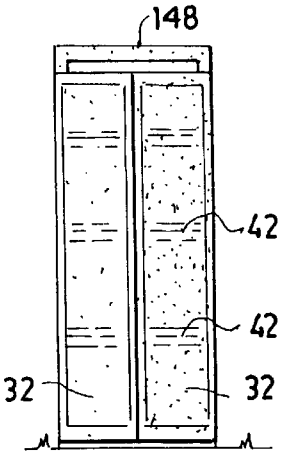
FIG. 76 is a rear view of the monument of FIG. 74.
Figure 86:
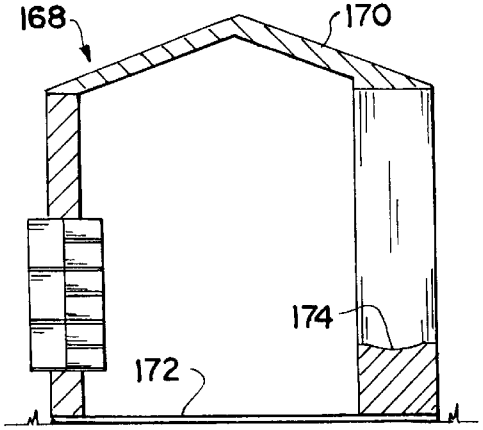
FIG. 86 is a sectional view of the monument of FIG. 81.

As shown in FIG. 76, the back face 32 of the body 14 includes inscriptions 42 which contain information about each of the deceased within the plot.

In the preferred embodiment illustrated in FIGS. 74–80, it is preferred that the cylinder 152 be substantially hollow so that it is relatively easy to rotate. Thus, to such end, one may construct the cylinder 152 from a suitable strong, durable, relatively lightweight material such as, e.g., the materials discussed elsewhere in this specification.

It will be seen in FIGS. 78 and 79 that the roof 148 preferably does not cover the rear half 162 of the cylinder 152, thus allowing sunlight to impact such portion 162 of the cylinder. In this embodiment, a reflective material 164 may be disposed between rear half 162 of the cylinder 152 and the body 160, within an arcuate slot 166. Thus sunlight will cause images from the rear half 162 of the cylinder 152 to be reflected towards a visitor.

Figure 83:
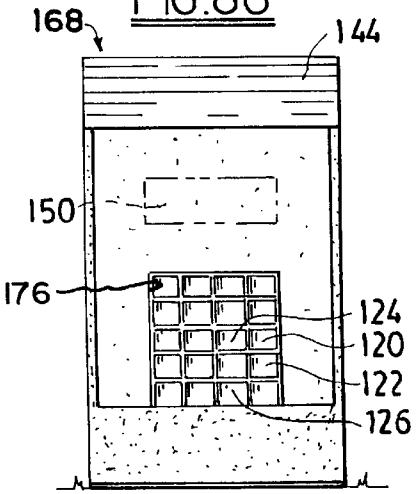
FIG. 83 is a front view of the monument of FIG. 81.
Figure 85:
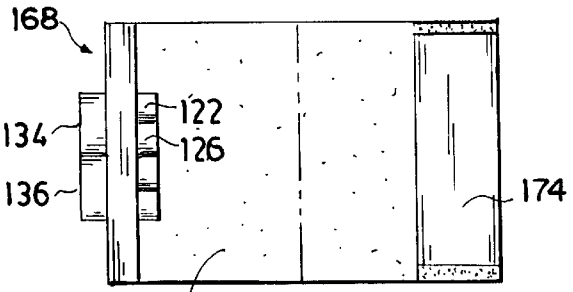
FIG. 85 is a plan view of the monument of FIG. 81.
Figure 82:
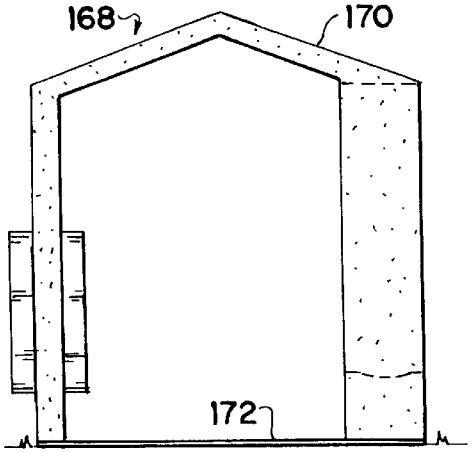
FIG. 82 is a side view of the monument of FIG. 81.
Figure 81:
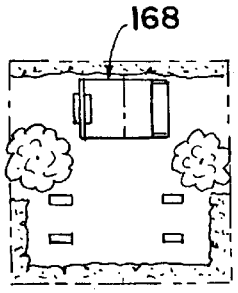
FIG. 81 is a site plan view of another preferred embodiment of a monument of this invention.
Figure 84:
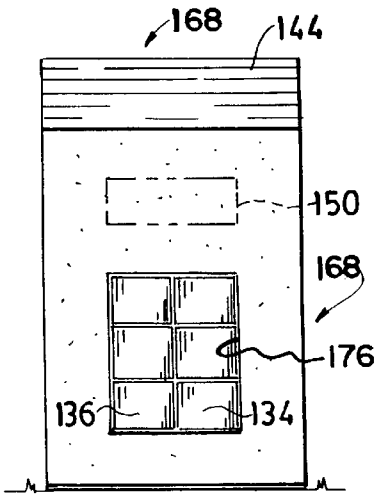
FIG. 84 is a rear view of the monument of FIG. 81.
Figure 88:
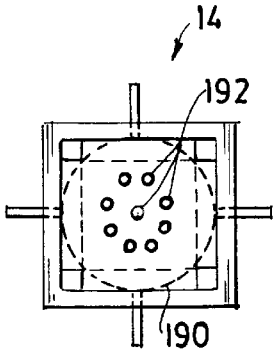
FIG. 88 is a plan view of the monument of FIG. 87.
Figure 90:
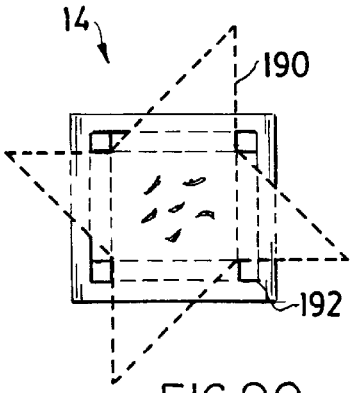
FIG. 90 is a plan view of the monument of FIG. 89.

FIGS. 81–86 illustrate a shelter 168 which is comprised of a roof 170, a floor 172, a bench 174, and a body 14 similar to that depicted in FIGS. 74–80. An opening 176 is provided to hold one or more of the blocks 120, 122, 124, 126 and 134 described above. As shown in FIGS. 83 and 84, an optional opening 177 can be provided for glass (or stained glass) to allow the entry of light.

FIGS. 87–90 illustrate another preferred embodiment of the invention in which the body 14 of a monument 10*n* has at least one face 178 formed with a recess 179 disposed in its lower portion which is adapted to receive a plate 180 (such as, e.g., a petal plate) on which an inscription 42 appears. In the embodiment illustrated in FIGS. 87–90, the recess 179 is comprised of a lower ledge 182 adapted to support an article such as, e.g., a bowl 184, a planter 186, a candle stick holder 188, and the like.

It will also be seen that the upper portion of body 14 is comprised of a cage 190 within which are disposed wind chimes 192 which are attached to the top 34 of body 14. The cage 190 allows wind to activate the wind chimes 192 but protects them from weather and vandals.

Figure 92:
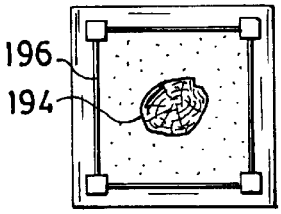
FIG. 92 is a plan view of the monument of FIG. 91.
Figure 87:
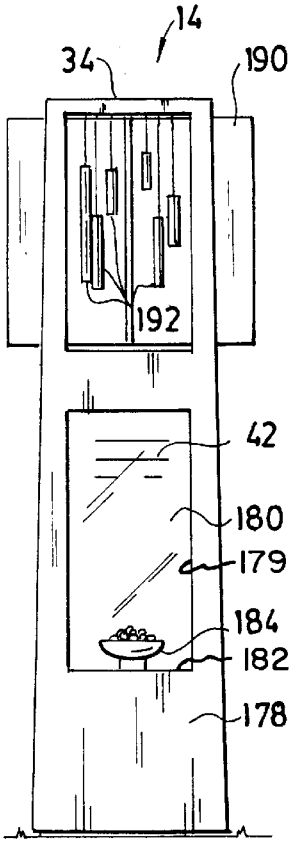
FIG. 87 is an elevational view of another preferred embodiment of a monument of this invention.
Figure 89:
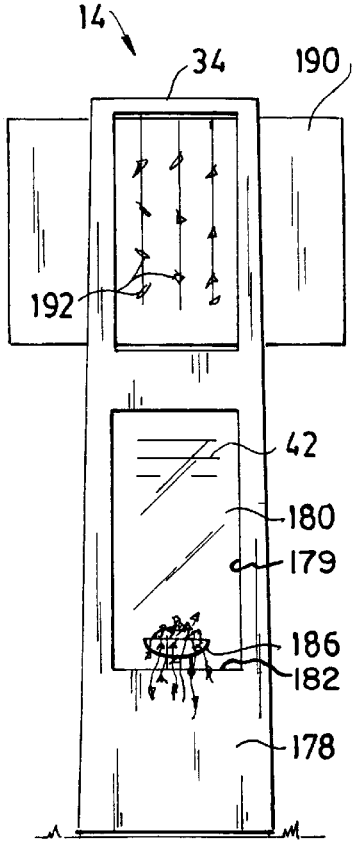
FIG. 89 is an elevational view of another preferred embodiment of a monument of this invention.
Figure 91:
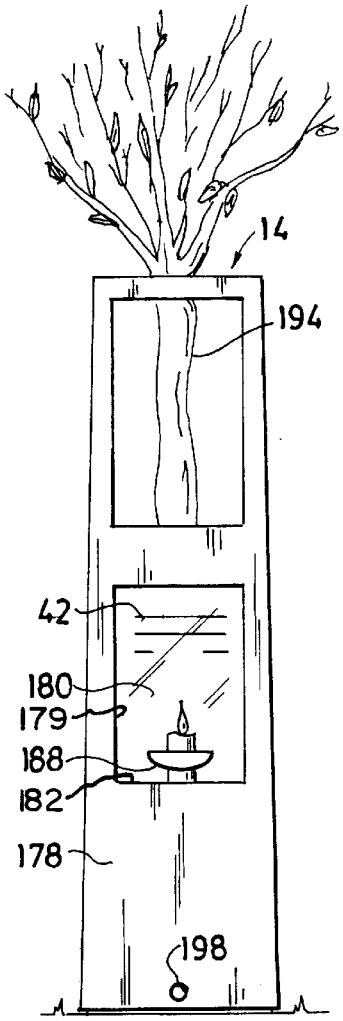
FIG. 91 is an elevational view of another preferred embodiment of a monument of this invention.

The embodiment of FIGS. 91 and 92 is similar to the embodiment of FIGS. 87 through 90 with the exception that the wind chimes 192 are replaced by plant (such as tree) 194, and the cage 190 is absent. In this embodiment it is preferred to utilize a welded steel liner 196 to enclose the roots of the plant 194. Suitable means may be used to drain water from plant 194 such as, e.g., drain cock 198 (see FIG. 91).

Figure 95:
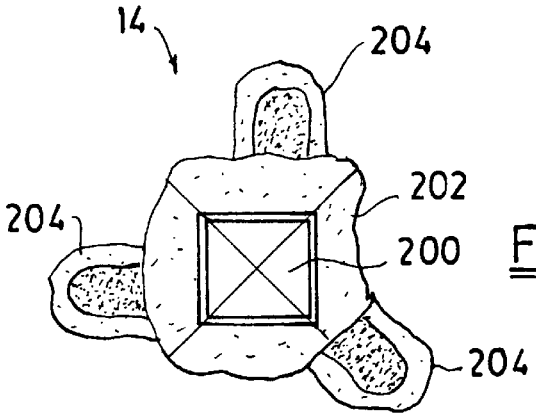
FIG. 95 is plan view of the monument of FIG. 93.
Figure 93:
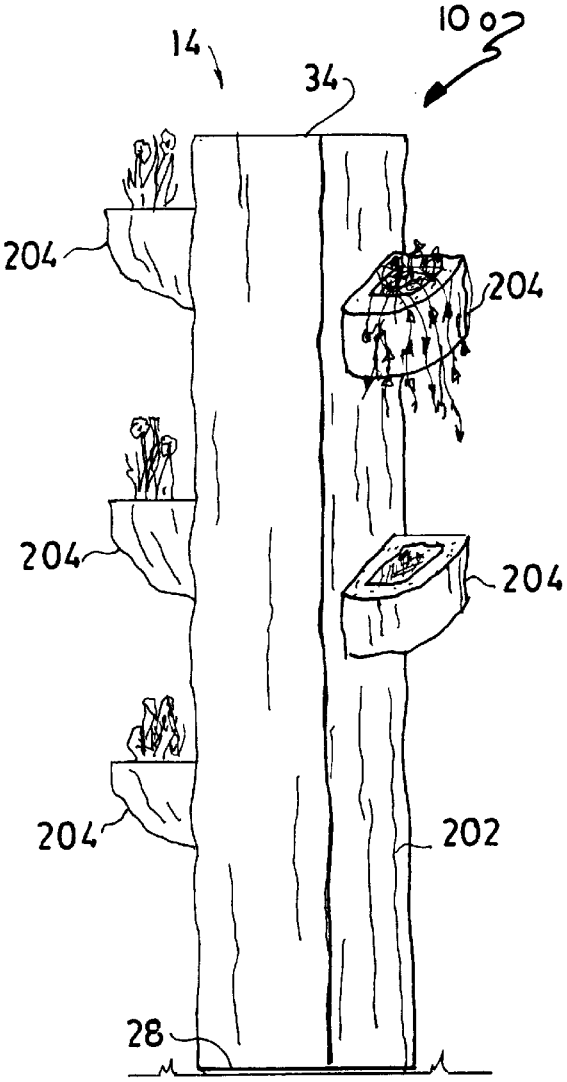
FIG. 93 is a perspective view of another preferred embodiment of a monument of this invention.
Figure 94:
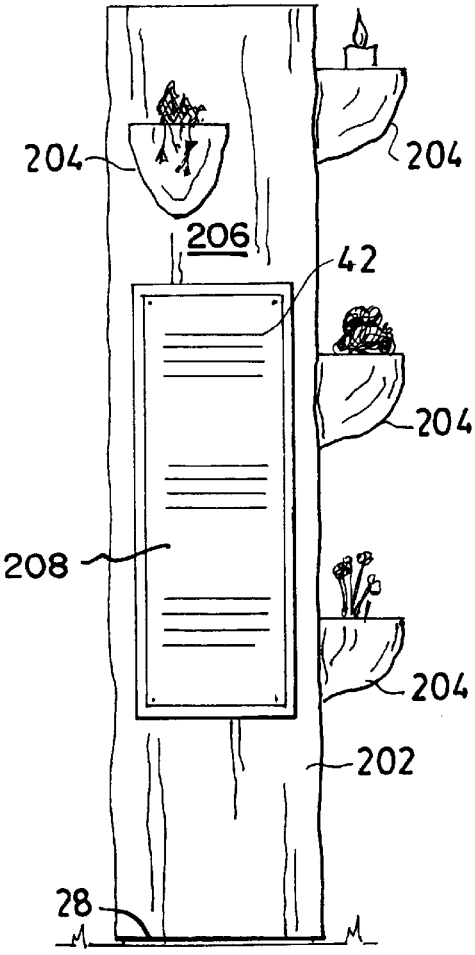
FIG. 94 is a front view of the monument of FIG. 93.

FIGS. 93–95 illustrate a monument 10*o* whose body 14 preferably contains a central orifice 200 extending from its top 34 to its bottom 28. In this embodiment, the body 14 is configured to resemble a tree trunk. Thus, its exterior surface 202 preferably presents a rough hewn appearance.

The body 14 preferably includes a multiplicity of recesses adapted tp receive irregularly shaped receptacles 204. These receptacles may be customized by the individual family members who present them for attachment to the body 14, and they may contain different plants, objects, and memory offerings given by different friends and family of the deceased.

It will also be seen that at least one face 206 of body 14 is used to support a plaque 208, which is mounted on such face and which may contain a suitable inscription 42.

Figure 98:
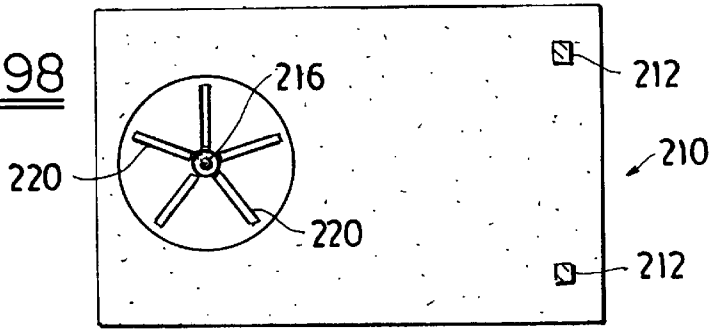
FIG. 98 is a plan view of the monument of FIG. 96.
Figure 97:
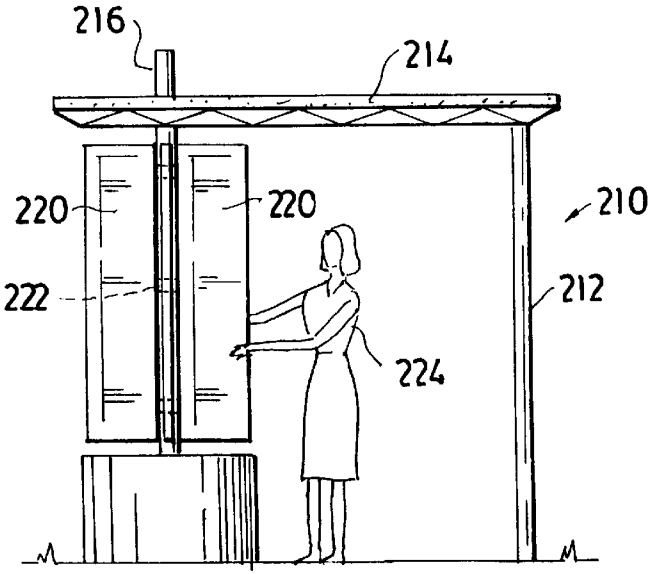
FIG. 97 is a side view of the monument of FIG. 96.
Figure 96:
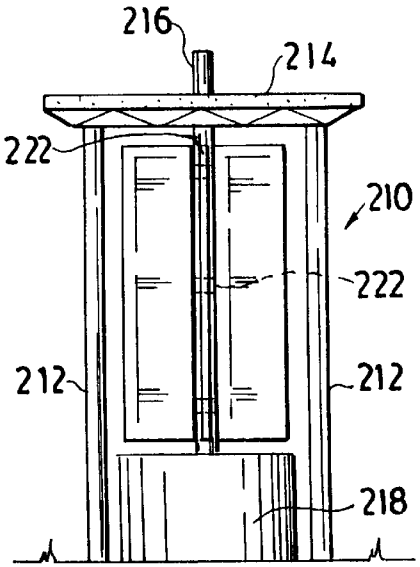
FIG. 96 a front view of another preferred embodiment of a monument of this invention.

FIGS. 96–98 illustrate a structure 210 comprising a support 212 and a roof 214. Mounted within roof 214 is a fixed shaft 216 which is connected to and supported by a base 218, and which, in the preferred embodiment illustrated in FIGS. 96 through 98, supports the roof 214.

Disposed around the fixed shaft 216 are a multiplicity of leaves (such as metal leaves) 220 which are each preferably rotatably connected to shaft 216 by means of collars 222. It is preferred that each such metal leaf 220 be connected to the shaft 216 by at least two of its own collars 222. Thus, the leaves 220 may be rotated around shaft 216 so that a visitor 224 may view the front and back of any one such leaf prior to the time he views the next such leaf.

As will be seen by reference to FIG. 97, the leaves 220 are disposed so that they contact neither the roof 214 nor the base 218. One or more inscriptions may be made therein. Thus, e.g., words may be cut through such leafs. Photographs, newspaper clippings, letters, and other documents may be attached to leafs. Thus, e.g., each such leaf may be assigned to one person buried in the plot, and suitable inscriptions may be made in the front and back of the leafs in the manner, e.g., described for the embodiment of FIG. 1.

Figure 99:
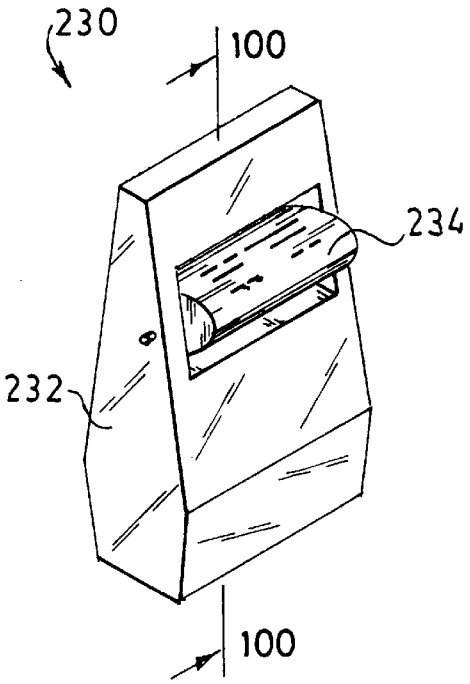
FIG. 99 is a perspective view of another preferred embodiment of a monument of this invention.
Figure 100:
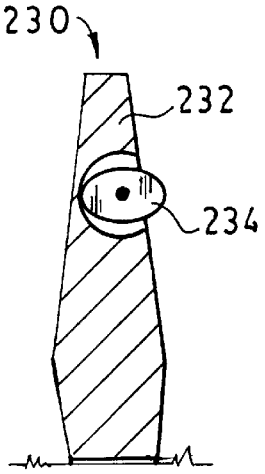
FIG. 100 is a side view of the monument of FIG. 99.

Various modifications can be made to the monuments and structures described above in connection with FIGS. 1–98. For example, FIG. 99 illustrates an alternative to the embodiment of FIGS. 1–6 in which a monument 230 includes a base 232 and a rotatable, ovoid-shaped element 234. FIG. 100 is a side view of the monument 230 of FIG. 99.

In another alternative embodiment, not shown, a viewing chamber comprised of a document to be viewed and a means of magnifying such document (such as the chamber 102 of FIG. 50) may be incorporated into any of the embodiments of this invention.

In another alternative embodiment, not shown, one or more of the memory blocks 114 (see FIG. 69) may be replaced by a locking receptacle 44 equipped with a door 46 (see FIG. 4).

In another alternative embodiment, not shown, instead of inscribing a surface of a body 14 (or instead of inscribing a plate attached to such surface), one may attach a photograph, a letter, or other document relating to the deceased.

In another alternative embodiment, not shown, one or more of the bodies 14 is equipped with a solar powered lighting system wherein the light can be on during the daytime and off at nighttime, or vice versa. In this embodiment, such a solar powered light can be used, in part or in whole, as a substitute for the candles-discussed in this specification.

In another alternative embodiment, not shown, one may equip one or more of the bodies 14 discussed herein with a video display activated by a switch. Such video display may be used, in whole or part, as a substitute for the metal plates discussed herein. In addition, one may use a touch sensitive screen to learn about the life of the deceased.

In another alternative embodiment, not shown, one may equip one or more of the bodies 14 with audio recordings in place of, in whole or in part, the video recordings discussed above. Alternatively, one may use video and audio recordings simultaneously.

In another alternative embodiment, any of the metal plates and/or any of the mosaics and/or any of the stained glass discussed hereinabove may be replaced, in whole or in part, with dichroic mirror glass. As is known to those skilled in the art, a dichroic mirror is a glass surface coated with a special metal film that reflects certain colors of light while allowing others to pass through.

Columbariums With Movable Elements

Figure 101:
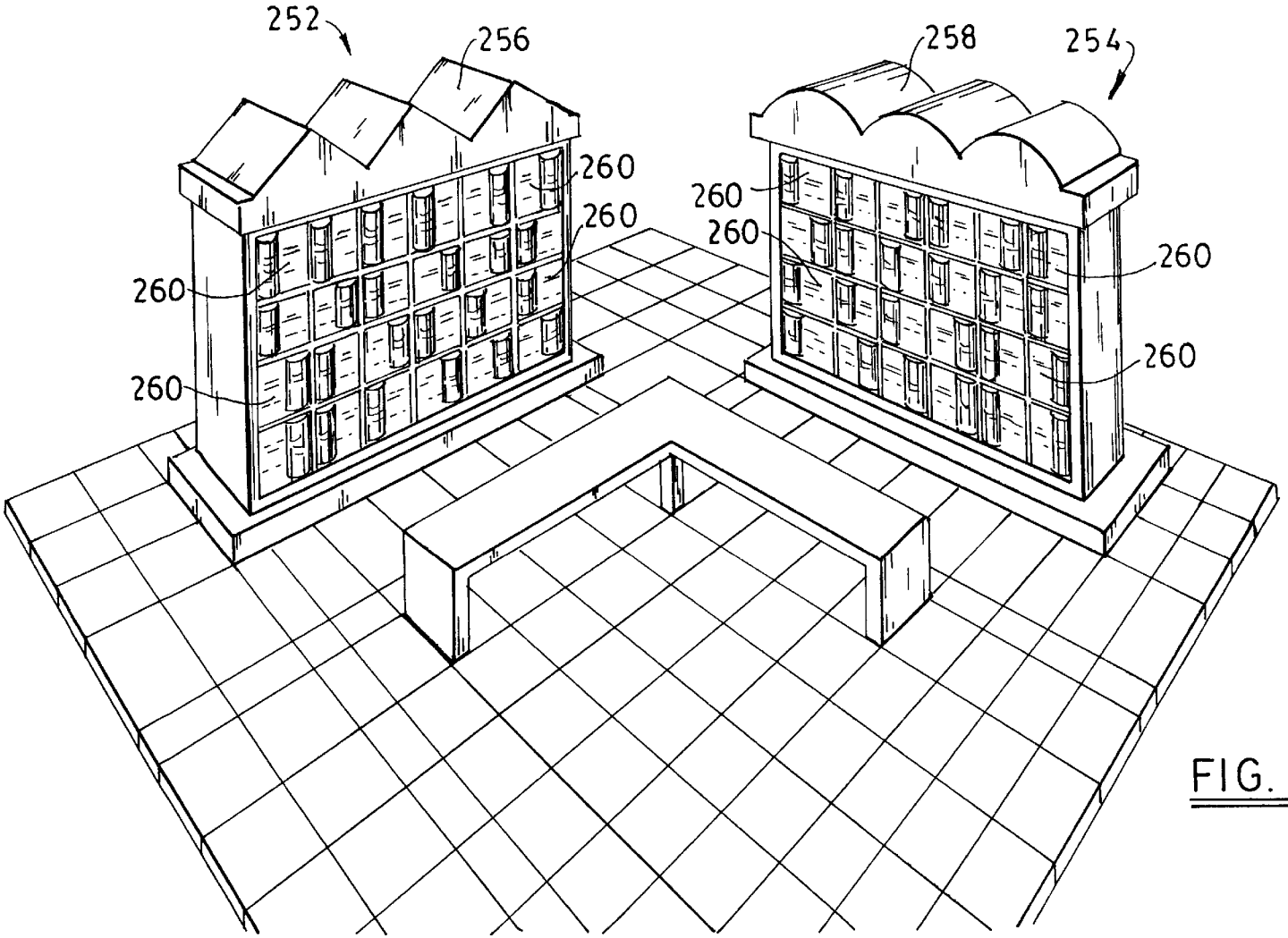
FIG. 101 is a perspective view of one preferred columbarium of this invention.

Referring now to FIG. 101 et seq., a second aspect of the invention relating to columbariums will now be described. FIG. 101 illustrates a pair of columbariums 252 and 254, which are illustrative of the columbariums that can utilize applicant's movable element structures. Other columbarium structures known to those skilled in the art also may be so used.

One such columbarium structure which may be so used is disclosed in U.S. Pat. No. 4,614,066, the disclosure of which is hereby incorporated by reference into this specification. The columbarium of this patent comprises a pair of preformed niche units, each of which has bottom and top walls and opposed side walls substantially normal to the bottom and top walls and imparting a substantially rectangular cross-section to the unit in elevation. The walls of this unit have front edges defining an open front for the unit, each unit having a foam plastic composition.

By way of further illustration, one may use the columbarium structures disclosed in U.S. Pat. Nos. 3,754,805, 3,905,167, 4,073,100, and 4,503,781. The disclosure of each of these United States patents is hereby incorporated by reference into this specification.

By way of yet further illustration, one columbarium structure which may be used can conveniently be prepared as a concrete casting with the concrete formed over prearranged tub-shaped molds. At the completion of the casting operation, the respective molds are removed to leave a unitary concrete structure with open niches formed therein and facing one side of the structure. This type of structure is illustrated in U.S. Pat. No. 4,566,668, the disclosure of which is hereby incorporated by reference into this specification.

By way of yet further illustration, one may use the columbarium structure disclosed in U.S. Pat. No. 5,195,812, the disclosure of which is hereby incorporated by reference into this specification. This patent discloses a columbarium which is constructed with a framework having risers extending vertically and having brackets mounted thereon. In this structure, the rods extend horizontally through the brackets to connect the risers. Shelves rest on the brackets and space the risers and also hide the tie rods for improved appearance.

By way of yet further illustration, one may use one or more of the columbarium structures disclosed in U.S. Pat. Nos. 1,300,173, 2,814,942, 3,655,065, 3,754,805, 3,879,096, 3,897,663, 4,073,425, 4,073,100, 4,614,066, and the like. The disclosure of each of these United States patents is hereby incorporated by reference into this specification.

Referring again to FIG. 101, and to the preferred embodiment illustrated therein, each of columbariums 252 and 254 are preferably constructed with a roof (256 and 258, respectively). In another embodiment, not shown, the columbarium does not have a roof.

Figure 102:
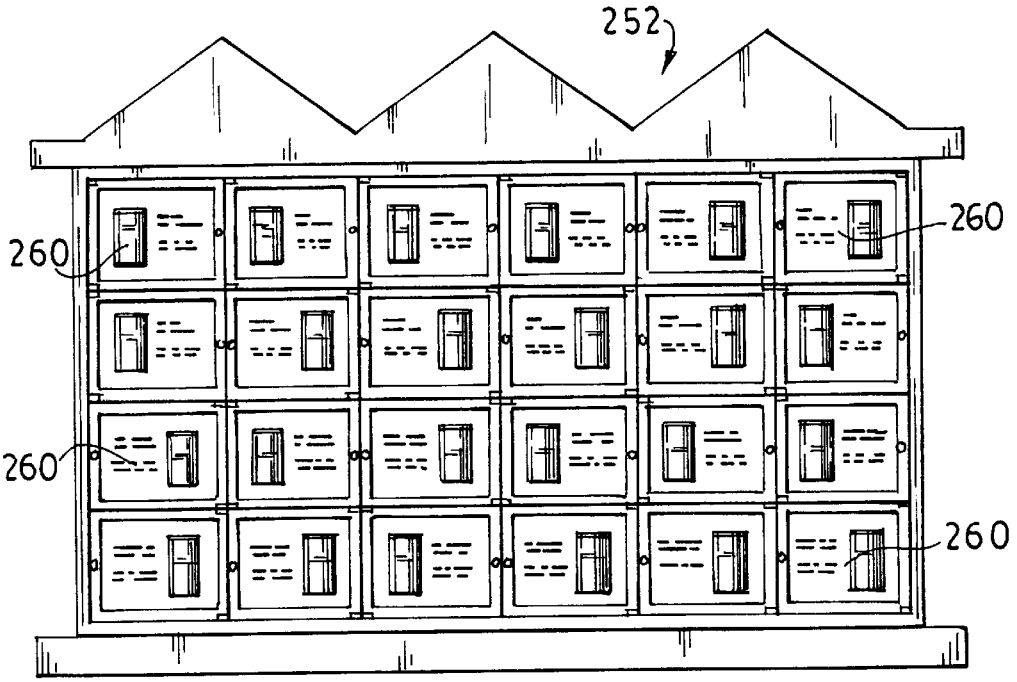
FIG. 102 is a front view of the columbarium of FIG. 101.
Figure 103:
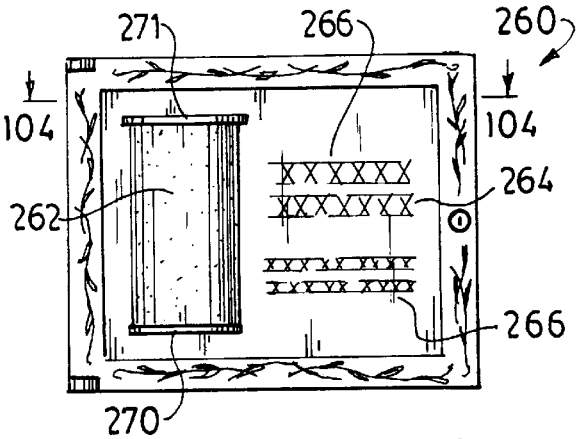
FIG. 103 is a front view of one niche of the columbarium of FIG. 101.
Figure 104:
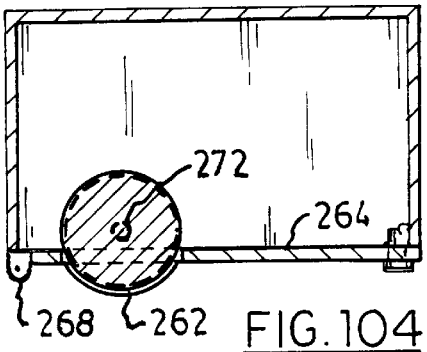
FIG. 104 is a sectional view of the niche of FIG. 103.

The columbariums 252 and 254 include a multiplicity of niches 260, which are shown in greater detail in FIGS. 102, 103, and 104. It is prefirred that the columbariums 252 and 254 each contain at least two niches, although generally the columbariums will have from about 24 to about 96 such niches. In one embodiment, the columbariums have at least about 36 niches.

In the preferred embodiment illustrated in FIGS. 101–105, each of the niches in columbariams 252 and 254 holds a "Scroll of Life" rotatable cylinder 262 (see FIGS. 103, 104, and 105) upon which is engraved the life story of the deceased. These engraved cylinders, which can be hollow for remains, may be black, cobalt, or parchment.

Figure 105:
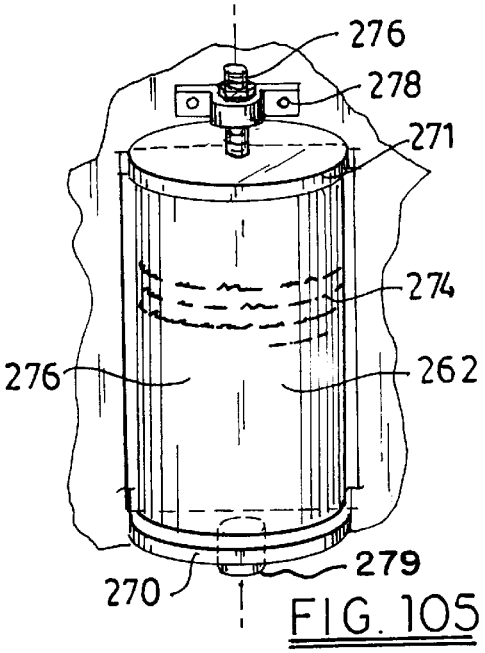
FIG. 105 is a perspective view of one preferred rotatable element of the niche of FIG. 103.

A preferred niche structure is illustrated in FIGS. 103, 104, and 105. In these figures, the niche 260 is provided with a rotatable cylinder 262 which extends through door 264. The door 264 is preferably made of bronze, is preferably hinged for access, and preferably locks.

In the preferred embodiment illustrated in FIGS. 103, 104, and 105, the niches are preferably about 12"×12" and hold urns full of cremated remains (not shown). Some niches hold one urn, and some larger niches hold two urns. The niches are preferably faced with granite on all exposed sides.

The colunbariums 252 and 254 may be attached to the ground (not shown) by conventional means. Thus, by way of illustration, the columbariums 252 and 254 may be attached to the ground by concrete, metal brackets, braces, and the like. Alternatively, the columbariums 252 and 254 may be built inside another structure and attached to the adjacent walls of such other structure. Alternatively, the columbariums 252 and 254 may be free standing.

When the columbariums are free standing, it is preferred that its exterior facing be made of stone. In one aspect of this embodiment, the stone clads a cubby hole system which can be made of metal, fiberglass, concrete, or stone. The cubby hole system is generally self-supporting.

FIG. 102 is a front view of the columbarium 252. FIG. 103 is a front view of a typical niche 260 in such columbarium 252. It will be seen in FIG. 3 that the niche 260 is preferably configured with a door 264, made from bronze or the like, which contains indicia 266. The indicia 266 may indicate, e.g., the name of the deceased, his or her date of birth, and his or her date of death. The door 264 is preferably hingably attached to the niche body 266 such as, e.g., by a hinge 268 (see FIG. 104).

Disposed within, and extending through the door 264 is the rotatable cylinder 262. The rotatable cylinder 262 is preferably rotatably connected to door 264. In one preferred aspect of this embodiment, the rotatable cylinder 262 is mounted on a base 270, and it is disposed between the base 270 and a hood 271, which protects it from the elements. The vertical axis 272 of the cylinder 262 is preferably disposed behind the door 264. A shaft 276 aligned with.the vertical axis 272 of the cylinder 262 may be rotatably attached to the door 264 by means of upper and lower fasteners 278 and 279, respectively.

In one embodiment, the cylinder 262 is removably attached to the door 264. The cylinder 262 in this embodiment may be removed from the niche 260 by opening the door 264 and releasing the cylinder 262 from behind.

As shown in FIG. 105, rotatable cylinder 162 may have indicia 274 inscribed on its face 276. Thus, the cylinder 262 can tell the life story of the person who died in pictures, words, or drawings, or it can be covered with psalms, poems, etc.

Figure 120:
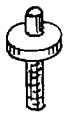
Figure 121:
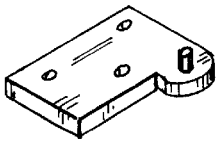

FIGS. 106–121 illustrate different fasteners which can be used to fasten a movable element such as the cylinder 262 in the niche 260. FIGS. 106–110 illustrate fasteners 278 for the top jamb portion. FIGS. 111–114 illustrate fasteners 268 for the door portion. FIGS. 115–119 illustrate fasteners 279 for the bottom jamb or sill portion. FIG. 120 illustrates a stud for marble or stone. FIG. 121 illustrates a floor plate.

Figure 122:
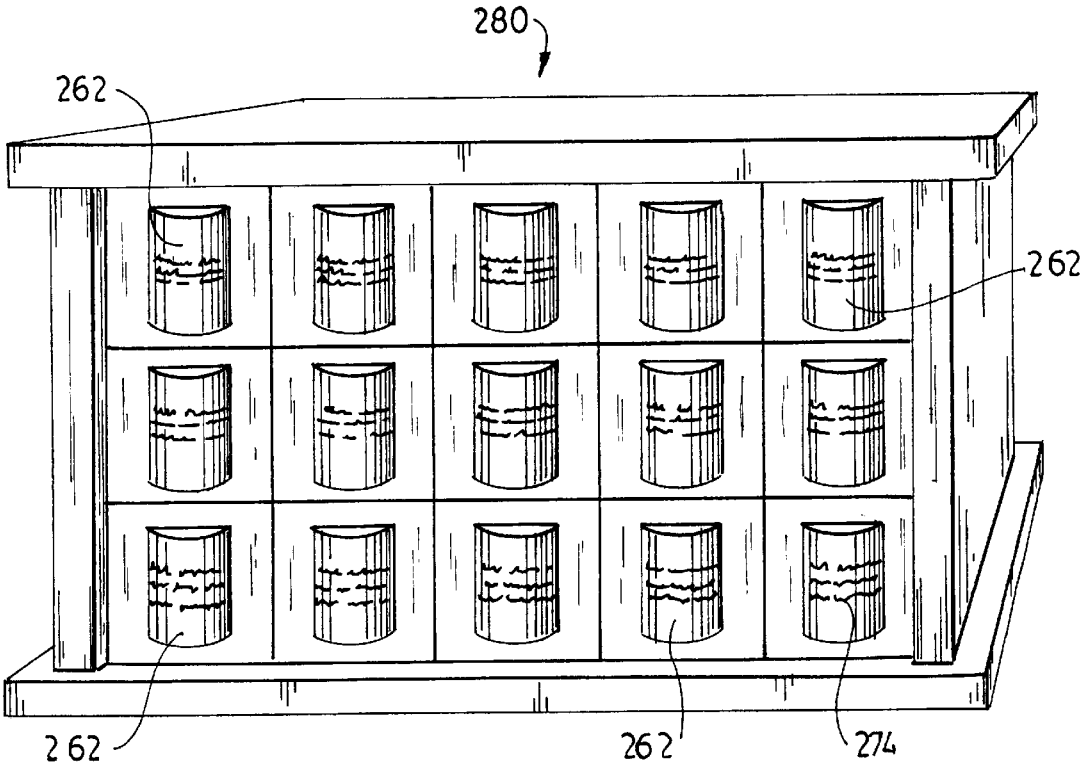
FIG. 122 is a perspective view of another preferred columbarium of the invention.

FIG. 122 is a perspective view of a "Wall of Life" structure 200 which is constructed with a multiplicity of rotatable elements 262, which each preferably contains indicia 274.

In the embodiments depicted in FIGS. 100–105 and 122, the movable element 262 is shown in the shape of a cylinder. As will be apparent to those skilled in the art, it may also have other shapes such as, e.g., an elongated rectangular box, a sphere, an ovoid, a square block, etc. Regardless of its shape, the movable element is preferably rotated to read its message(s).

Turning now to FIGS. 123–127, a niche 280 representing an alternative embodiment to the niche 260 is shown in which a movable display element is recessed so as not to extend beyond the exterior front face of the niche. This concept could also be applied to the movable elements used in the monuments described above.

The niche 280 may be constructed as one of a plurality of six-sided compartments or enclosures in one or both of the columbariums 252 and 254, or in any of the other columbarium structures described above. A movable element 282, which could be a cylinder, an ovoid or any of the other shapes described above, is rotatably mounted within the niche 280. The movable element 282 is positioned so as to be viewable through an opening 284 formed in a door 286 of the niche 280. The door could be hinged to the niche so as to be openable relative thereto, or the door could be removably secured to the niche using removable fasteners such as the four screws 288.

The opening 284 in the door 286 is trimmed by a decorative frame member 290 that is secured to the door using fasteners, such as the four screws 289. The frame member 290 could be made from bronze, stainless steel, aluminum, plastic or any other suitably rigid material. It includes a flat peripheral portion 292 and a central reveal portion 294 that defines a recessed window 296 through which the movable element 282 is viewable. The window 296 has vertically extending side edges 298 and curved top and bottom edges 300 (only one is shown) such that the window 296 conforms to the shape of the movable element 282, but is spaced therefrom to permit rotation of the movable element 282.

As shown in FIG. 124, an advantage of the embodiment of FIGS. 123–127 is that the movable element 282 is sufficiently recessed in the niche so that no portion thereof extends beyond the front surface of the door 286. This helps protect the movable element from damage caused by the environment and provides a sleek look.

The movable element 282 can be rotatably mounted in a variety of ways to any of the interior walls of the niche 280 or to the door 286 itself. FIG. 125 illustrates a preferred construction in which the movable element 282 is mounted to the floor 302 of the niche 280 via an adjustable support base structure 304. The support base 304 includes a lower base plate 306 made from metal, plastic or any other suitably rigid material, and is affixed to the niche floor 302 using an adhesive bond 308. Any other suitable connection, such as fasteners, could also be used.

As shown in FIG. 126, the base plate 306 has a plurality of, e.g. four, threaded stubs 310, which may be provided by countersunk screws, extending upwardly therefrom. A spacer 312 is mounted on each stub 310 and a movable bearing support plate 314 rests on top of each of the spacers 312. The bearing support plate 314 has a plurality of, e.g. four, apertures 316 in it to receive the stubs 310. The apertures 316 are oversized so as to be substantially larger than the diameter of the stubs 310 so that the bearing support plate can be moved in a plane that is parallel to the niche floor 302. This provides an adjustable connection between the movable element 282 and the niche 280. This facilitates positioning of the movable element 282 relative to the opening 284 in the door 286 as described in more detail below. The bearing support plate is secured in position by connecters 318, which may be provided by wing nuts or the like, that are threaded on each of the stubs 310, along with optional washers 320.

The bearing support plate 314 supports a bearing assembly 322 which is preferably a Teflon (TM) rollerless bearing. The bearing assembly 322 thus includes an outer race member 324 which may be formed as a cup-shaped receptacle made from low friction material. The bearing assembly also includes an inner race member 326 which may be formed as disk member made from low friction material and sized to fit (with slight clearance) into the cup-shaped receptacle of the outer race member 324. The outer race member 324 is attached to the bearing support plate 314 using a plurality of, e.g. four, fasteners 328 which may be countersunk screws or the like. A mounting plate 330 is attached to the top of the inner race member 326, using a plurality of, e.g., four, fasteners 332 which may be countersunk screws or the like. The mounting plate 330 is also attached to the movable element 282 using an adhesive bond 334, or any other suitable attachment method such as fasteners.

In order to help retain the inner race member 326 in engagement with the outer race member 324, to prevent the movable element 282 from being knocked over or otherwise displaced, the bearing assembly 322 may include a removable bearing cap 334 to retain the inner race member 326 in position with respect to the outer race member 324. In that case, the bearing cap 334 is attached using a plurality of, e.g., four, fasteners 335 which may be countersunk screws or the like.

In other bearing designs, such as that shown in FIG. 127, the bearing assembly 322 is constructed as a self-contained unit, and requires no bearing cap. Such a bearing assembly 322 might be a ball bearing unit in which a plurality of bearing balls 336 are positioned between the outer race member 324 and the inner race member 326.

It will be seen that the adjustable support base structure 304 supports the movable element 282 for rotational movement about its central verticle axis. If necessary, the connectors 318 can be loosened so that the position of the movable bearing support plate 314 can be changed. This facilitates adjustment of the movable element relative to the opening 284 and the door 286 of the niche 260. This allows the movable element 286 to be aligned with the window 296 so that the curved surface of the movable element 286 conforms to the curvature of the adjacent curved edges 300 of the window 296.

Monument, Marker And Columbarium With Imprinted Image

Turning now to FIGS. 128–133, another aspect of the invention is illustrated in which nonverbal indicia are used on flat grave markers, upright monuments, pedestal monuments, columbariums, and the like to provide information about the deceased. Such nonverbal indicia especially include imprints made by casting deceased's hands, feet, or any other object of interest, in contrast to surface relief sculpted images. In accordance with this aspect of the invention, it is proposed that before a person dies, that person would make a cast of their own hands, or anything else of interest. The casting would be made into a metal plaque that is incorporated into either a flat lawn level marker, an upright stone monument, a columbarium, or any other conveivable memorial.

FIG. 128 illustrates a flat grave marker 340 of the type that is designed to be mounted flush to the ground. The grave marker 340 can be made from granite, bronze, or any other suitably durable material. The names of two deceased individuals, such as a husband and a wife, are inscribed at 342. A pair of plates 344 bearing imprints 345 of the deceased individuals' hands are mounted on either side of the inscribed names. The plates 344 can be mounted in a variety of ways including set screws extending through the sides of the plates 344, dowels mounted in the rear of the plates 344, frames secured over the edges of the plates 344, etc.

FIG. 129 illustrates a flat grave marker 346 which is constructed in similar fashion to the grave marker 340 except that the names of the deceased individuals are inscribed at side locations 348 and 350, while a single plate 352 bearing imprints 353 of the deceased individuals' hands is mounted at the middle of the grave marker 346.

FIG. 130 illustrates a columbarium niche 354 which has a plate 356 made from bronze, aluminum, plastic or any other suitable material mounted on the door thereof. The plate is mounted to the door of the niche 354 using a plurality of, e.g. four, fasteners 358 which may be screws or the like. The plate 356 bears an inscription 360 providing information about the deceased. A nonverbal indicia is provided by mounting a secondary plate 362 made from bronze, aluminum, plastic or any other suitable material onto the plate 356. The secondary plate 362 has inprints 364 of the deceased individual's hands. Imprints of other body parts, or any other nonverbal indicia, could also be used.

FIG. 131 illustrates a columbarium niche 366 which is constructed in similar fashion to the columbrium niche 354 except that only a single plate 368 is mounted on the door thereof. The plate 368 can be made from bronze, aluminum, plastic or any other suitable material and is mounted to the niche 354 using a plurality of, e.g. four, fasteners 370 which could be screws or the like. The plate 368 has imprints 372 of the deceased individual's hands. Imprints of other body parts, or any other nonverbal indicia, could also be used.

Figure 132:
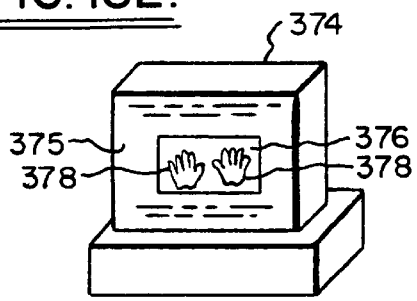
FIG. 132 is a perspective view of an upright monument constructed in accordance with another aspect of the invention.

FIG. 132 illustrates an upright monument 374 which can be constructed from granite or any other suitable material. The monument 374 has a vertical front face 375 which is inscribed with information about the deceased. Mounted on the vertical front face 375 of the monument 374 is a plate 376 made from bronze, aluminum, plastic or any other suitable material. The plate 376 can be mounted on the monument 374 in any of the ways described above in connection with FIGS. 128–13 1, and bears imprints 378 of the deceased individual's hands. Imprints of other body parts, or any other nonverbal indicia, could also be used.

Figure 133:
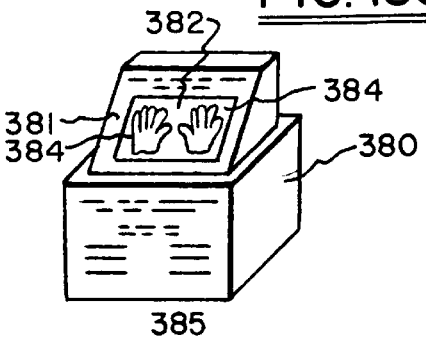

FIG. 133 illustrates a pedestal monument 380 which can be constructed in similar fashion to the monument 374 of FIG. 132, except that the monument 380 has an angled front face 381. The angled front face 381 is inscribed with information about the deceased. Mounted on the angled front face of the monument 380 is a plate 382 made from bronze, aluminum, plastic or any other suitable material. The plate 382 can be mounted on the monument 374 in any of the ways described above in connection with FIGS. 128–131, and bears imprints 384 of the deceased individual's hands. Imprints of other body parts, or any other nonverbal indicia, could also be used. Additional inscriptions could be placed on the vertical front face 385 of the base of the monument 380.

Metal Marker Displaying Summary And Detailed Information

Figure 134:
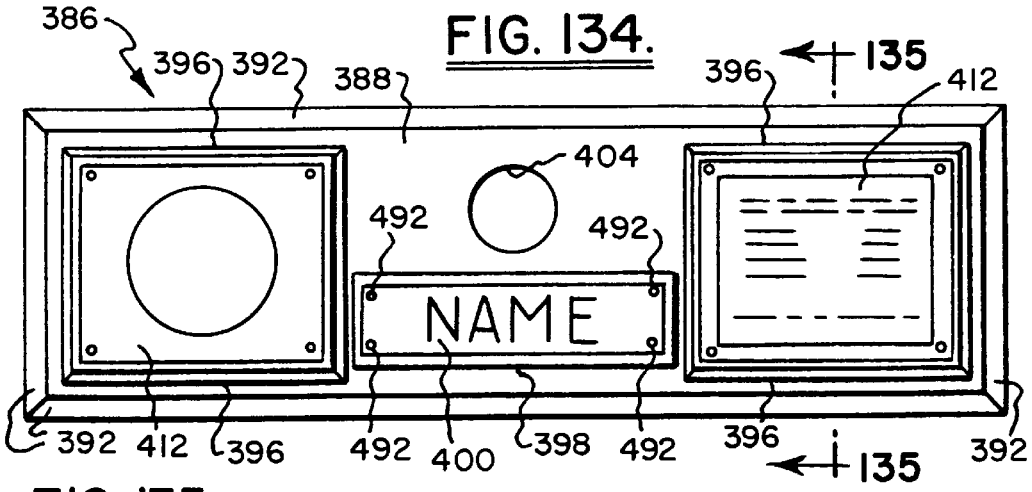
Figure 135:
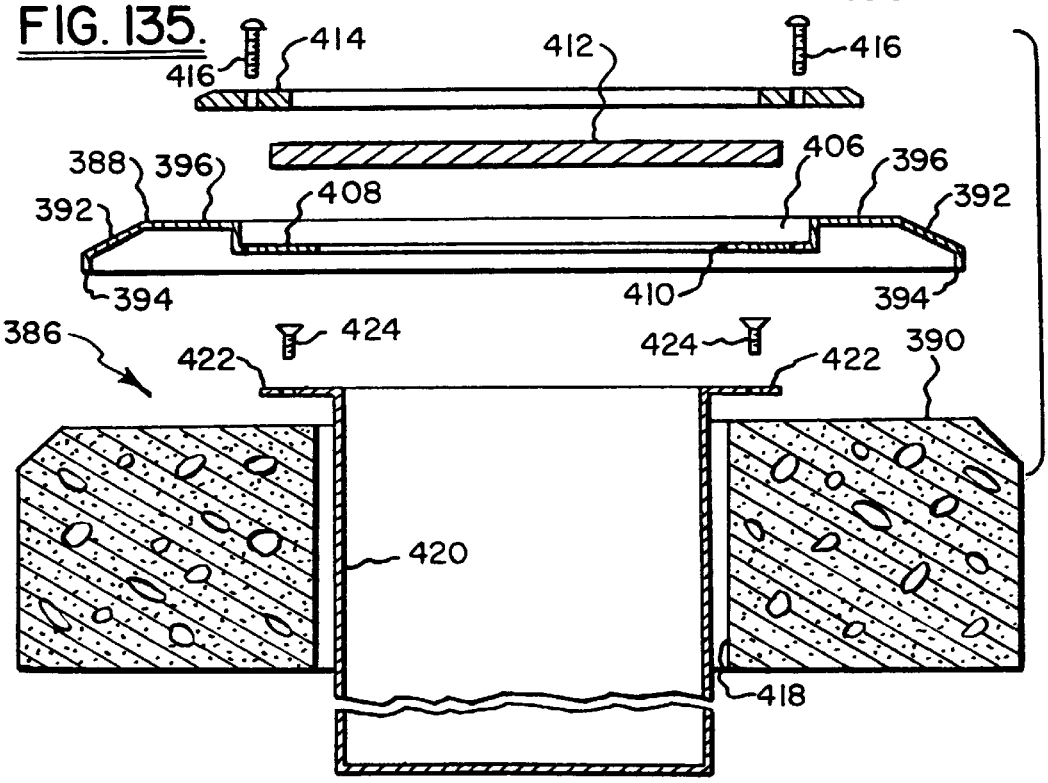

Turning now to FIGS. 134 and 135, another aspect of the invention is shown in which an improved flush mounted grave marker 386 is provided. This type of grave marker, which is designed to be mounted flush to the ground, is common in the Western United States. They can be made from a variety of materials but are most commonly made from cast bronze. One of the objections raised with respect to these bronze markers is that it is impossible, due to the limitations of casting technology, to display on the marker more than minimal information such as a name, a date, an emblem, and a short epitaph.

In the marker 386 of FIGS. 134 and 135, a bronze base plate 388 is mounted over a foundation member 390 made from concrete or the like, which is placed in the ground so that its top surface is flush with ground level. The bronze base plate 388 has four beveled sides 392 that extend inwardly and upwardly from a lower periphery 394 that rests on top of the foundation member 390, to a raised interior planar portion 396. At a central area 398 of the interior planar portion 396, a limited amount of information such as a name, a date, etc. is cast into the base plate 388. Alternatively, a secondary plate 400, made from bronze, aluminum, plastic or any other suitable material can be formed with such information and removeably attached to the base plate 388 using a plurality of, e.g., four, fasteners 402 which could be screws, for example. Also optionally located at the central area 398 of the base plate 388 is a cylindrical well 404 that can be used for holding objects, for example a standard gorham vase (not shown).

The base plate 388 is additionally formed with shallow recessess 406 (see FIG. 135) on either side of the central area 398 of the base plate 388. The shallow recesses 406 have a flat lower surface 408 in which is formed a central aperature 410. The recesses 406 are sized to receive and support an information bearing insert plate 412 made from a readily inscribable material such as granite so that a relatively detailed message can be formed thereon in comparison the limited information that can be cast into bronze. The recesses 406 are made to be deep enough so as to receive the information bearing insert plate 412 without the insert plate extending upwardly beyond the upper surface of the interior planar portion 396 of the base plate 388.

A frame member 414 is mounted over the information bearing insert plate 412 to secure the insert plate in place. The frame member 414, as well as the lower surface 408 of each recess 406, is formed with apertures in order to receive fasteners 416, which may be screws or the like. The fasteners 416 retain the insert plates 412 in place within the recesses 406.

As shown in FIGS. 134 and 135, the foundation member 390 may include a pair of cylindrical wells 418 formed therein below the locations of the insert plates 412. The wells 412 are sized to receive a cremation cannister 420. The cannister 420 has a flat upper lip 422 that rests on the upper surface of the foundation member 390, which is used for securing the cannister 420 to the foundation member 390 using suitable fasteners 424 such as screws. Clearance for the upper lip is provided by controlling the depth of the recesses 406 so that the vertical distance between the bottom surface of each recess 406 and the lower periphery 394 of the base plate 388 exceeds the thickness of the lip 422.

Thus, a substantially more detailed inscription can be provided on a metallic grave marker than could otherwise be achieved using traditional casting methods. While the embodiment of FIGS. 134 and 135 has been described in relation to flat grave markers, the techniques incorportated in that embodiment could be applied to other kinds of markers and monuments, and also to columbariums, where the casting of metal otherwise limits the amount of information to be conveyed.

It is to be understood that the aforementioned description is illustrative only and that changes can be made in the apparatus and its constituent components, as well as in other aspects of the invention discussed herein, without departing from the scope of the invention as defined in the following claims.

I claim:

1. A grave marker, said grave marker comprising:

a base plate support structure adapted to be mounted substantially flush to the ground;

a first surface portion on said base plate support structure bearing imprinted information about a deceased individual;

a second surface portion on said base plate support structure;

a recess formed in said second surface portion, said recess being defined by an opening in said second surface portion and a lower support surface that is recessed from said second surface portion below said opening, said lower support surface being for supporting a plate, and said opening being at least as large as said lower support surface so that a plate can be inserted into and removed from said recess through said opening;

a substantially planar plate element mounted in said recess over said lower support surface so as to be substantially flush with said second surface portion, said plate element displaying additional imprinted information about a deceased individual; and removable fasteners removably securing said plate element in said recess.

2. The grave marker recited in claim 1, wherein:

said first surface portion on said base plate support structure is imprinted with text information about a deceased individual; and said plate element displays an imprinted image made by a cast shape.

3. The grave marker recited in claim 1, wherein:

said base plate support structure is metallic; and said plate element is a non-metallic display element mounted on said metallic base plate support structure, said non-metallic display element bearing detailed information about a deceased individual.

4. The grave marker recited in claim 1 wherein said non-metallic display element is secured to said metallic base plate support structure by a frame removably attached to said metallic base plate support structure.

5. The grave marker recited in claim 3 wherein said metallic base plate support structure is secured to a foundation structure mounted in the ground, said foundation structure having a well formed therein for receiving a cremation cannister, said well being disposed below said non-metallic display element, and said non-metallic display element being removably mounted to said metallic base plate support structure to allow access to said well.

6. A grave marker, said grave marker comprising:

a base plate support structure adapted to be mounted substantially flush to the ground;

a first surface portion on said base plate support structure bearing imprinted information about a deceased individual whose grave is marked by said marker;

a second surface portion on said base plate support structure for supporting a plate; and a substantially planar plate element mounted on said second surface portion of said base plate support structure so as to be substantially flush therewith, said plate element having a surface portion formed with a three-dimensional figure of a uniquely identifying body part feature of said deceased individual, said three-dimensional figure being made from a casting captured directly from said uniquely identifying body part feature to provide a full scale, permanent, nonregeneratable record that uniquely identifies said deceased individual to grave-site viewers.

7. A grave marker, said grave marker comprising:

a metallic base plate support structure adapted to be mounted substantially flush to the ground;

a first surface portion on said base plate support structure bearing imprinted information about a deceased individual, said information being imprinted as a casting;

a second surface portion on said base plate support structure for supporting a plate; and a substantially planar non-metallic display plate element mounted on said second surface portion of said base plate support structure, said non-metallic display plate element being inscribed with detailed text information about a deceased individual.

8. An upright monument for a grave, said upright monument comprising:

an upright vertical display surface;

a first portion on said vertical display surface bearing text information about a deceased individual whose grave is marked by said upright monument;

a second portion of said vertical display surface; and a plate mounted on said second portion of said vertical display surface, said plate having a surface portion formed with a three-dimensional figure of a uniquely identifying body part feature of said deceased individual, said three-dimensional figure being made from a casting captured directly from said uniquely identifying body part feature to provide a full scale, permanent, nonregeneratable record that uniquely identifies said deceased individual to grave-site viewers.

9. A pedestal monument for a grave, said pedestal monument comprising:

an angled upwardly facing display surface;

a first portion on said angled display surface bearing text information about a deceased individual whose grave is marked by said pedestal monument;

a second portion of said angled display surface; and a plate mounted on said second portion of said angled display surface, said plate having a surface portion formed with a three-dimensional figure of a uniquely identifying body part feature of said deceased individual, said three-dimensional figure being made from a casting captured directly from said uniquely identifying body part feature to provide a full scale, permanent, nonregeneratable record that uniquely identifies said deceased individual to grave-site viewers.

10. An upright monument for a grave, said upright monument comprising:

an upright vertical display surface;

a first portion on said vertical display surface bearing text information about a deceased individual whose grave is marked by said upright monument;

a hole formed in said vertical display surface, said hole being defined in part by a lower generally horizontal surface; and a plate mounted on said lower surface, said plate having a surface portion formed with a three-dimensional figure of a hand of said deceased individual, said three-dimensional figure being made from a casting captured directly from said decease individual's hand to provide a full scale, permanent, nonregeneratable record that uniquely identifies said deceased individual to grave-site viewers.

* * * * *